US008755709B2

(12) United States Patent
Nose

(10) Patent No.: US 8,755,709 B2
(45) Date of Patent: Jun. 17, 2014

(54) IMAGE FORMING SYSTEM AND CONTROL APPARATUS UTILIZING DUAL IMAGE FORMING APPARATUSES

(75) Inventor: Katsuya Nose, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 13/233,316

(22) Filed: Sep. 15, 2011

(65) Prior Publication Data

US 2012/0070176 A1 Mar. 22, 2012

(30) Foreign Application Priority Data

Sep. 22, 2010 (JP) ..... 2010-212707

(51) Int. Cl.
*G03G 15/00* (2006.01)
*G03G 15/23* (2006.01)

(52) U.S. Cl.
CPC ..... *G03G 15/231* (2013.01)
USPC ..... 399/82; 399/85

(58) Field of Classification Search
CPC ... G03G 15/23; G03G 15/231; G03G 15/238; G03G 2215/00021
USPC ..... 399/18, 19, 82, 85
See application file for complete search history.

(56) References Cited

U.S. PATENT DOCUMENTS

| | | | | |
|---|---|---|---|---|
| 4,579,446 | A | 4/1986 | Fujino et al. | |
| 6,567,621 | B2 * | 5/2003 | Miyoshi et al. | 399/19 |
| 7,103,306 | B2 * | 9/2006 | Shimizubata | 399/306 |
| 8,494,392 | B2 * | 7/2013 | Kasahara | 399/76 |

FOREIGN PATENT DOCUMENTS

JP 06-343125 A 12/1994

* cited by examiner

*Primary Examiner* — William J Royer
(74) *Attorney, Agent, or Firm* — Fitzpatrick, Cella, Harper & Scinto

(57) ABSTRACT

A control apparatus can control at least one of a first image forming apparatus and a second image forming apparatus connected downstream of the first image forming apparatus. When switching from a first mode to a second mode, if the second image forming apparatus is unable to perform image forming on a second side of a sheet whose first side has undergone image forming in the second image forming apparatus before the second image forming apparatus performs image forming on a second side of a sheet whose first side has undergone image forming in the first image forming apparatus, an order of the sheet whose first and second sides undergo image forming in the second image forming apparatus and the sheet whose first side undergoes image forming in the first image forming apparatus and whose second side undergoes image forming in the second image forming apparatus is not swapped.

3 Claims, 22 Drawing Sheets

FIG. 11

CONVENTIONAL EXAMPLE

| step | OUTPUT | SECOND IMAGE FORMING APPARATUS | | | | | | CONNECTION | FIRST IMAGE FORMING APPARATUS | | | | | |
|---|---|---|---|---|---|---|---|---|---|---|---|---|---|---|
| | | 21 | 22 | 23 | 24 | 25 | 26 | A | 11 | 12 | 13 | 14 | 15 | 16 |
| 1 | | 1 | | | | | | | | | | | | |
| 2 | | | 1 | | | | | | | | | | | |
| 3 | | 2 | | 1 | | | | | | | | | | |
| 4 | | | 2 | | 1 | | | | | | | | | |
| 5 | | 3 | | 2 | | 1 | | | | | | | | |
| 6 | | | 3 | | 2 | | 1 | | | | | | | |
| I 7 | | 1 | | 3 | | 2 | | | | | | | | |
| 8 | | 4 | 1 | | 3 | | 2 | | | | | | | |
| 9 | | 2 | 4 | 1 | | 3 | | | | | | | | |
| 10 | 1 | 5 | 2 | 4 | | | 3 | | | | | | | |
| 11 | | 3 | 5 | 2 | 4 | | | | | | | | | |
| 12 | 2 | 6 | 3 | 5 | | 4 | | | | | | | | |
| 13 | | | 6 | 3 | 5 | | 4 | | | | | | | |
| 14 | 3 | 4 | | 6 | | 5 | | | | | | | | |
| 15 | | 7 | 4 | | 6 | | 5 | | | | | | | |
| 16 | | 5 | 7 | 4 | | 6 | | | | | | | | |
| 17 | 4 | 8 | 5 | 7 | | | 6 | | | | | | | |
| 18 | | 6 | 8 | 5 | 7 | | | | | | | | | |
| 19 | 5 | 9 | 6 | 8 | | 7 | | | | | | | | |
| 20 | | | 9 | 6 | 8 | | 7 | | | | | | | |
| 21 | 6 | 7 | | 9 | | 8 | | | | | | | | |
| II 22 | | 10 | 7 | | 9 | | 8 | | | | | | | |
| 23 | | 8 | 10 | 7 | | 9 | | | | | | | | |
| 24 | 7 | 11 | 8 | 10 | | | 9 | | | | | | | |
| 25 | | 9 | 11 | 8 | 10 | | | | | | | | | |
| 26 | 8 | 12 | 9 | 11 | | 10 | | | | | | | | |
| 27 | | | 12 | 9 | 11 | | 10 | | | | | | | |
| 28 | 9 | 10 | | 12 | | 11 | | | | | | | | |
| 29 | | 13 | 10 | | 12 | | 11 | | | | | | | |
| 30 | | 11 | 13 | 10 | | 12 | | | | | | | | |
| 31 | 10 | 14 | 11 | 13 | | | 12 | | | | | | | |
| 32 | | 12 | 14 | 11 | 13 | | | | | | | | | |
| 33 | 11 | 15 | 12 | 14 | | 13 | | | | | | | | |
| 34 | | | 15 | 12 | 14 | | 13 | | | | | | | |
| 35 | 12 | 13 | | 15 | | 14 | | | | | | | | |
| 36 | | 16 | 13 | | 15 | | 14 | | | | | | | |
| 37 | | 14 | 16 | 13 | | 15 | | | | | | | | |
| 38 | 13 | 17 | 14 | 16 | | | 15 | | | | | | | |
| 39 | | 15 | 17 | 14 | 16 | | | | | | | | | |
| 40 | 14 | 18 | 15 | 17 | | 16 | | | | | | | | |
| 41 | | | 18 | 15 | 17 | | 16 | | | | | | | |
| 42 | 15 | 16 | | 18 | | 17 | | | | | | | | |
| 43 | | 19 | 16 | | 18 | | 17 | | | | | | | |
| 44 | | 17 | 19 | 16 | | 18 | | | | | | | | |
| 45 | 16 | 20 | 17 | 19 | | | 18 | | | | | | | |
| 46 | | 18 | 20 | 17 | 19 | | | | | | | | | |
| 47 | 17 | 21 | 18 | 20 | | 19 | | | | | | | | |
| 48 | | | 21 | 18 | 20 | | 19 | | | | | | | |

FIG. 12

EMBODIMENT NO. 1

| | step | OUTPUT | SECOND IMAGE FORMING APPARATUS | | | | | | CONNECTION | FIRST IMAGE FORMING APPARATUS | | | | | |
|---|---|---|---|---|---|---|---|---|---|---|---|---|---|---|---|
| | | | 21 | 22 | 23 | 24 | 25 | 26 | A | 11 | 12 | 13 | 14 | 15 | 16 |
| | 1 | | 1 | | | | | | | | | | | | |
| | 2 | | | 1 | | | | | | | | | | | |
| | 3 | | 2 | | 1 | | | | | | | | | | |
| | 4 | | | 2 | | 1 | | | | | | | | | |
| | 5 | | 3 | | 2 | | 1 | | | | | | | | |
| | 6 | | | 3 | | 2 | | 1 | | | | | | | |
| I | 7 | | 1 | | 3 | | 2 | | | | | | | | |
| | 8 | | 4 | 1 | | 3 | | 2 | | | | | | | |
| | 9 | | 2 | 4 | 1 | | 3 | | | | | | | | |
| | 10 | 1 | 5 | 2 | 4 | | | 3 | | | | | | | |
| | 11 | | 3 | 5 | 2 | 4 | | | | | | | | | |
| | 12 | 2 | 6 | 3 | 5 | | 4 | | | | | | | | |
| | 13 | | | 6 | 3 | 5 | | 4 | | | | | | | |
| | 14 | 3 | 4 | | 6 | | 5 | | | | | | | | |
| | 15 | | 7 | 4 | | 6 | | 5 | | | | | | | |
| | 16 | | 5 | 7 | 4 | | 6 | | | | | | | | |
| | 17 | 4 | 8 | 5 | 7 | | | 6 | | | | | | | |
| | 18 | | 6 | 8 | 5 | 7 | | | | | | | | | |
| | 19 | 5 | 9 | 6 | 8 | | 7 | | | | | | | | |
| | 20 | | | 9 | 6 | 8 | | 7 | | | | | | | |
| | 21 | 6 | 7 | | 9 | | 8 | | | | | | | | |
| | 22 | | 10 | 7 | | 9 | | 8 | | | | | | | |
| II | 23 | | 8 | 10 | 7 | | 9 | | | | | | | | |
| | 24 | 7 | | 8 | 10 | | | 9 | | | | | | | |
| | 25 | | 9 | | 8 | 10 | | | | 11 | | | | | |
| | 26 | 8 | | 9 | | | 10 | | | 12 | 11 | | | | |
| | 27 | | | | 9 | | | 10 | | 13 | 12 | 11 | | | |
| | 28 | 9 | 10 | | | | | | 11 | 14 | 13 | 12 | | | |
| | 29 | | 11 | 10 | | | | | 12 | 15 | 14 | 13 | | | |
| | 30 | | 12 | 11 | 10 | | | | 13 | 16 | 15 | 14 | | | |
| | 31 | 10 | 13 | 12 | 11 | | | | 14 | 17 | 16 | 15 | | | |
| | 32 | 11 | 14 | 13 | 12 | | | | 15 | 18 | 17 | 16 | | | |
| | 33 | 12 | 15 | 14 | 13 | | | | 16 | 19 | 18 | 17 | | | |
| | 34 | 13 | 16 | 15 | 14 | | | | 17 | 20 | 19 | 18 | | | |
| | 35 | 14 | 17 | 16 | 15 | | | | 18 | 21 | 20 | 19 | | | |
| | 36 | 15 | 18 | 17 | 16 | | | | 19 | 22 | 21 | 20 | | | |
| | 37 | 16 | 19 | 18 | 17 | | | | 20 | 23 | 22 | 21 | | | |
| | 38 | 17 | 20 | 19 | 18 | | | | 21 | 24 | 23 | 22 | | | |
| | 39 | 18 | 21 | 20 | 19 | | | | 22 | 25 | 24 | 23 | | | |
| | 40 | 19 | 22 | 21 | 20 | | | | 23 | 26 | 25 | 24 | | | |
| | 41 | 20 | 23 | 22 | 21 | | | | 24 | 27 | 26 | 25 | | | |
| | 42 | 21 | 24 | 23 | 22 | | | | 25 | 28 | 27 | 26 | | | |
| | 43 | 22 | 25 | 24 | 23 | | | | 26 | 29 | 28 | 27 | | | |
| | 44 | 23 | 26 | 25 | 24 | | | | 27 | 30 | 29 | 28 | | | |
| | 45 | 24 | 27 | 26 | 25 | | | | 28 | 31 | 30 | 29 | | | |
| | 46 | 25 | 28 | 27 | 26 | | | | 29 | 32 | 31 | 30 | | | |
| | 47 | 26 | 29 | 28 | 27 | | | | 30 | 33 | 32 | 31 | | | |
| | 48 | 27 | 30 | 29 | 28 | | | | 31 | 34 | 33 | 32 | | | |

FIG. 13

EMBODIMENT NO. 2

| | step | OUTPUT | SECOND IMAGE FORMING APPARATUS ★ | | | | | | CONNECTION | FIRST IMAGE FORMING APPARATUS ★ | | | | | |
|---|---|---|---|---|---|---|---|---|---|---|---|---|---|---|---|
| | | | 21 | 22 | 23 | 24 | 25 | 26 | A | 11 | 12 | 13 | 14 | 15 | 16 |
| | 1 | | 1 | | | | | | | | | | | | |
| | 2 | | | 1 | | | | | | | | | | | |
| | 3 | | 2 | | 1 | | | | | | | | | | |
| | 4 | | | 2 | | 1 | | | | | | | | | |
| | 5 | | 3 | | 2 | | 1 | | | | | | | | |
| | 6 | | | 3 | | 2 | | 1 | | | | | | | |
| I | 7 | | 1 | | 3 | | 2 | | | | | | | | |
| | 8 | | 4 | 1 | | 3 | | 2 | | | | | | | |
| | 9 | | 2 | 4 | 1 | | 3 | | | | | | | | |
| | 10 | 1 | 5 | 2 | 4 | | | 3 | | | | | | | |
| | 11 | | 3 | 5 | 2 | 4 | | | | | | | | | |
| | 12 | 2 | 6 | 3 | 5 | | 4 | | | | | | | | |
| | 13 | | | 6 | 3 | 5 | | 4 | | | | | | | |
| | 14 | 3 | 4 | | 6 | | 5 | | | | | | | | |
| | 15 | | 7 | 4 | | 6 | | 5 | | | | | | | |
| | 16 | | 5 | 7 | 4 | | 6 | | | | | | | | |
| | 17 | 4 | 8 | 5 | 7 | | | 6 | | | | | | | |
| | 18 | | 6 | 8 | 5 | 7 | | | | | | | | | |
| | 19 | 5 | 9 | 6 | 8 | | 7 | | | | | | | | |
| | 20 | | | 9 | 6 | 8 | | 7 | | | | | | | |
| | 21 | 6 | 7 | | 9 | | 8 | | | | | | | | |
| | 22 | | | 7 | | 9 | | 8 | | | | | | | |
| II | 23 | | 8 | | 7 | | 9 | | | 10 | | | | | |
| | 24 | 7 | | 8 | | | | 9 | | 11 | 10 | | | | |
| | 25 | | 9 | | 8 | | | | | 12 | 11 | 10 | | | |
| | 26 | 8 | | 9 | | | | | 10 | 13 | 12 | 11 | | | |
| | 27 | | 10 | | 9 | | | | 11 | 14 | 13 | 12 | | | |
| | 28 | 9 | 11 | 10 | | | | | 12 | 15 | 14 | 13 | | | |
| | 29 | | 12 | 11 | 10 | | | | 13 | 16 | 15 | 14 | | | |
| | 30 | 10 | 13 | 12 | 11 | | | | 14 | 17 | 16 | 15 | | | |
| | 31 | 11 | 14 | 13 | 12 | | | | 15 | 18 | 17 | 16 | | | |
| | 32 | 12 | 15 | 14 | 13 | | | | 16 | 19 | 18 | 17 | | | |
| | 33 | 13 | 16 | 15 | 14 | | | | 17 | 20 | 19 | 18 | | | |
| | 34 | 14 | 17 | 16 | 15 | | | | 18 | 21 | 20 | 19 | | | |
| | 35 | 15 | 18 | 17 | 16 | | | | 19 | 22 | 21 | 20 | | | |
| | 36 | 16 | 19 | 18 | 17 | | | | 20 | 23 | 22 | 21 | | | |
| | 37 | 17 | 20 | 19 | 18 | | | | 21 | 24 | 23 | 22 | | | |
| | 38 | 18 | 21 | 20 | 19 | | | | 22 | 25 | 24 | 23 | | | |
| | 39 | 19 | 22 | 21 | 20 | | | | 23 | 26 | 25 | 24 | | | |
| | 40 | 20 | 23 | 22 | 21 | | | | 24 | 27 | 26 | 25 | | | |
| | 41 | 21 | 24 | 23 | 22 | | | | 25 | 28 | 27 | 26 | | | |
| | 42 | 22 | 25 | 24 | 23 | | | | 26 | 29 | 28 | 27 | | | |
| | 43 | 23 | 26 | 25 | 24 | | | | 27 | 30 | 29 | 28 | | | |
| | 44 | 24 | 27 | 26 | 25 | | | | 28 | 31 | 30 | 29 | | | |
| | 45 | 25 | 28 | 27 | 26 | | | | 29 | 32 | 31 | 30 | | | |
| | 46 | 26 | 29 | 28 | 27 | | | | 30 | 33 | 32 | 31 | | | |
| | 47 | 27 | 30 | 29 | 28 | | | | 31 | 34 | 33 | 32 | | | |
| | 48 | 28 | 31 | 30 | 29 | | | | 32 | 35 | 34 | 33 | | | |

FIG. 14

EMBODIMENT NO. 3

| | step | OUTPUT | SECOND IMAGE FORMING APPARATUS | | | | | | CONNE-CTION | FIRST IMAGE FORMING APPARATUS | | | | | |
|---|---|---|---|---|---|---|---|---|---|---|---|---|---|---|---|
| | | | 21 | 22 | 23 | 24 | 25 | 26 | A | 11 | 12 | 13 | 14 | 15 | 16 |
| | 1 | | 1 | | | | | | | | | | | | |
| | 2 | | | 1 | | | | | | | | | | | |
| | 3 | | 2 | | 1 | | | | | | | | | | |
| | 4 | | | 2 | | 1 | | | | | | | | | |
| | 5 | | 3 | | 2 | | 1 | | | | | | | | |
| | 6 | | | 3 | | 2 | | 1 | | | | | | | |
| I | 7 | | 1 | | 3 | | 2 | | | | | | | | |
| | 8 | | 4 | 1 | | 3 | | 2 | | | | | | | |
| | 9 | | 2 | 4 | 1 | | 3 | | | | | | | | |
| | 10 | 1 | 5 | 2 | 4 | | | 3 | | | | | | | |
| | 11 | | 3 | 5 | 2 | 4 | | | | | | | | | |
| | 12 | 2 | 6 | 3 | 5 | | 4 | | | | | | | | |
| | 13 | | | 6 | 3 | 5 | | 4 | | | | | | | |
| | 14 | 3 | 4 | | 6 | | 5 | | | | | | | | |
| | 15 | | 7 | 4 | | 6 | | 5 | | | | | | | |
| | 16 | | 5 | 7 | 4 | | 6 | | | | | | | | |
| | 17 | 4 | 8 | 5 | 7 | | | 6 | | | | | | | |
| | 18 | | 6 | 8 | 5 | 7 | | | | | | | | | |
| | 19 | 5 | 9 | 6 | 8 | | 7 | | | | | | | | |
| | 20 | | | 9 | 6 | 8 | | 7 | | | | | | | |
| | 21 | 6 | 7 | | 9 | | 8 | | | | | | | | |
| | 22 | | 11 | 7 | | 9 | | 8 | | | | | | | |
| II | 23 | | 8 | 11 | 7 | | 9 | | | 10 | | | | | |
| | 24 | 7 | | 8 | 11 | | | 9 | | | 10 | | | | |
| | 25 | | 9 | | 8 | 11 | | | | 12 | | 10 | | | |
| | 26 | 8 | | 9 | | | 11 | | 10 | 13 | 12 | | | | |
| | 27 | | 10 | | 9 | | | 11 | | 14 | 13 | 12 | | | |
| | 28 | 9 | 11 | 10 | | | | | 12 | 15 | 14 | 13 | | | |
| | 29 | | 12 | 11 | 10 | | | | 13 | 16 | 15 | 14 | | | |
| | 30 | 10 | 13 | 12 | 11 | | | | 14 | 17 | 16 | 15 | | | |
| | 31 | 11 | 14 | 13 | 12 | | | | 15 | 18 | 17 | 16 | | | |
| | 32 | 12 | 15 | 14 | 13 | | | | 16 | 19 | 18 | 17 | | | |
| | 33 | 13 | 16 | 15 | 14 | | | | 17 | 20 | 19 | 18 | | | |
| | 34 | 14 | 17 | 16 | 15 | | | | 18 | 21 | 20 | 19 | | | |
| | 35 | 15 | 18 | 17 | 16 | | | | 19 | 22 | 21 | 20 | | | |
| | 36 | 16 | 19 | 18 | 17 | | | | 20 | 23 | 22 | 21 | | | |
| | 37 | 17 | 20 | 19 | 18 | | | | 21 | 24 | 23 | 22 | | | |
| | 38 | 18 | 21 | 20 | 19 | | | | 22 | 25 | 24 | 23 | | | |
| | 39 | 19 | 22 | 21 | 20 | | | | 23 | 26 | 25 | 24 | | | |
| | 40 | 20 | 23 | 22 | 21 | | | | 24 | 27 | 26 | 25 | | | |
| | 41 | 21 | 24 | 23 | 22 | | | | 25 | 28 | 27 | 26 | | | |
| | 42 | 22 | 25 | 24 | 23 | | | | 26 | 29 | 28 | 27 | | | |
| | 43 | 23 | 26 | 25 | 24 | | | | 27 | 30 | 29 | 28 | | | |
| | 44 | 24 | 27 | 26 | 25 | | | | 28 | 31 | 30 | 29 | | | |
| | 45 | 25 | 28 | 27 | 26 | | | | 29 | 32 | 31 | 30 | | | |
| | 46 | 26 | 29 | 28 | 27 | | | | 30 | 33 | 32 | 31 | | | |
| | 47 | 27 | 30 | 29 | 28 | | | | 31 | 34 | 33 | 32 | | | |
| | 48 | 28 | 31 | 30 | 29 | | | | 32 | 35 | 34 | 33 | | | |

FIG. 17

CONVENTIONAL EXAMPLE ★ ★

| step | OUTPUT | SECOND IMAGE FORMING APPARATUS | | | | | | CONNE-CTION | FIRST IMAGE FORMING APPARATUS | | | | | |
|---|---|---|---|---|---|---|---|---|---|---|---|---|---|---|
| | | 21 | 22 | 23 | 24 | 25 | 26 | A | 11 | 12 | 13 | 14 | 15 | 16 |
| 1 | | | | | | | | | 1 | | | | | |
| 2 | | | | | | | | | | 1 | | | | |
| 3 | | | | | | | | | 2 | | 1 | | | |
| 4 | | | | | | | | | | 2 | | 1 | | |
| 5 | | | | | | | | | 3 | | 2 | | 1 | |
| I 6 | | | | | | | | | | 3 | | 2 | | 1 |
| 7 | | | | | | | | | 1 | | 3 | | 2 | |
| 8 | | | | | | | | | 4 | 1 | | 3 | | 2 |
| 9 | | | | | | | | | 2 | 4 | 1 | | 3 | |
| 10 | | | | | | | | 1 | 5 | 2 | 4 | | | 3 |
| 11 | | 1 | | | | | | | 3 | 5 | 2 | 4 | | |
| 12 | | | 1 | | | | | 2 | 6 | 3 | 5 | | 4 | |
| 13 | | 2 | | 1 | | | | | | 6 | 3 | 5 | | 4 |
| 14 | 1 | | 2 | | | | | 3 | 4 | | 6 | | 5 | |
| 15 | | 3 | | 2 | | | | | 7 | 4 | | 6 | | 5 |
| 16 | 2 | | 3 | | | | | | 5 | 7 | 4 | | 6 | |
| 17 | | | | 3 | | | | 4 | 8 | 5 | 7 | | | 6 |
| 18 | 3 | 4 | | | | | | | 6 | 8 | 5 | 7 | | |
| 19 | | | 4 | | | | | 5 | 9 | 6 | 8 | | 7 | |
| 20 | | 5 | | 4 | | | | | | 9 | 6 | 8 | | 7 |
| 21 | 4 | | 5 | | | | | 6 | 7 | | 9 | | 8 | |
| II 22 | | 6 | | 5 | | | | | 10 | 7 | | 9 | | 8 |
| 23 | 5 | | 6 | | | | | | 8 | 10 | 7 | | 9 | |
| 24 | | | | 6 | | | | 7 | 11 | 8 | 10 | | | 9 |
| 25 | 6 | 7 | | | | | | | 9 | 11 | 8 | 10 | | |
| 26 | | | 7 | | | | | 8 | 12 | 9 | 11 | | 10 | |
| 27 | | 8 | | 7 | | | | | | 12 | 9 | 11 | | 10 |
| 28 | 7 | | 8 | | | | | 9 | 10 | | 12 | | 11 | |
| 29 | | 9 | | 8 | | | | | 13 | 10 | | 12 | | 11 |
| 30 | 8 | | 9 | | | | | | 11 | 13 | 10 | | 12 | |
| 31 | | | | 9 | | | | 10 | 14 | 11 | 13 | | | 12 |
| 32 | 9 | 10 | | | | | | | 12 | 14 | 11 | 13 | | |
| 33 | | | 10 | | | | | 11 | 15 | 12 | 14 | | 13 | |
| 34 | | 11 | | 10 | | | | | | 15 | 12 | 14 | | 13 |
| 35 | 10 | | 11 | | | | | 12 | 13 | | 15 | | 14 | |
| 36 | | 12 | | 11 | | | | | 16 | 13 | | 15 | | 14 |
| 37 | 11 | | 12 | | | | | | 14 | 16 | 13 | | 15 | |
| 38 | | | | 12 | | | | 13 | 17 | 14 | 16 | | | 15 |
| 39 | 12 | 13 | | | | | | | 15 | 17 | 14 | 16 | | |
| 40 | | | 13 | | | | | 14 | 18 | 15 | 17 | | 16 | |
| 41 | | 14 | | 13 | | | | | | 18 | 15 | 17 | | 16 |
| 42 | 13 | | 14 | | | | | 15 | 16 | | 18 | | 17 | |
| 43 | | 15 | | 14 | | | | | 19 | 16 | | 18 | | 17 |
| 44 | 14 | | 15 | | | | | | 17 | 19 | 16 | | 18 | |
| 45 | | | | 15 | | | | 16 | 20 | 17 | 19 | | | 18 |
| 46 | 15 | 16 | | | | | | | 18 | 20 | 17 | 19 | | |
| 47 | | | 16 | | | | | 17 | 21 | 18 | 20 | | 19 | |
| 48 | | 17 | | 16 | | | | | | 21 | 18 | 20 | | 19 |

FIG. 18

EMBODIMENT NO. 4

| | step | OUTPUT | SECOND IMAGE FORMING APPARATUS | | | | | | CONNECTION | FIRST IMAGE FORMING APPARATUS | | | | | |
|---|---|---|---|---|---|---|---|---|---|---|---|---|---|---|---|
| | | | 21 | 22 | 23 | 24 | 25 | 26 | A | 11 | 12 | 13 | 14 | 15 | 16 |
| | 1 | | | | | | | | | 1 | | | | | |
| | 2 | | | | | | | | | | 1 | | | | |
| | 3 | | | | | | | | | 2 | | 1 | | | |
| | 4 | | | | | | | | | | 2 | | 1 | | |
| | 5 | | | | | | | | | 3 | | 2 | | 1 | |
| | 6 | | | | | | | | | | 3 | | 2 | | 1 |
| I | 7 | | | | | | | | | 1 | | 3 | | 2 | |
| | 8 | | | | | | | | | 4 | 1 | | 3 | | 2 |
| | 9 | | | | | | | | | 2 | 4 | 1 | | 3 | |
| | 10 | | | | | | | | 1 | 5 | 2 | 4 | | | 3 |
| | 11 | | 1 | | | | | | | 3 | 5 | 2 | 4 | | |
| | 12 | | | 1 | | | | | 2 | 6 | 3 | 5 | | 4 | |
| | 13 | | 2 | | 1 | | | | | | 6 | 3 | 5 | | 4 |
| | 14 | 1 | | 2 | | | | | 3 | 4 | | 6 | | 5 | |
| | 15 | | 3 | | 2 | | | | | 7 | 4 | | 6 | | 5 |
| | 16 | 2 | | 3 | | | | | | 5 | 7 | 4 | | 6 | |
| | 17 | | | | 3 | | | | 4 | 8 | 5 | 7 | | | 6 |
| | 18 | 3 | 4 | | | | | | | 6 | 8 | 5 | 7 | | |
| | 19 | | | 4 | | | | | 5 | 9 | 6 | 8 | | 7 | |
| | 20 | | 5 | | 4 | | | | | | 9 | 6 | 8 | | 7 |
| | 21 | 4 | | 5 | | | | | 6 | 7 | | 9 | | 8 | |
| | 22 | | 6 | | 5 | | | | | 10 | 7 | | 9 | | 8 |
| II | 23 | 5 | | 6 | | | | | | 8 | 10 | 7 | | 9 | |
| | 24 | | | | 6 | | | | 7 | | 8 | 10 | | | 9 |
| | 25 | 6 | 7 | | | | | | | 9 | | 8 | 10 | | |
| | 26 | | | 7 | | | | | 8 | | 9 | | | 10 | |
| | 27 | | 8 | | 7 | | | | | | | 9 | | | 10 |
| | 28 | 7 | | 8 | | | | | 9 | 10 | | | | | |
| | 29 | | 9 | | 8 | | | | | 11 | 10 | | | | |
| | 30 | 8 | | 9 | | | | | | 12 | 11 | 10 | | | |
| | 31 | | | | 9 | | | | 10 | 13 | 12 | 11 | | | |
| | 32 | 9 | 10 | | | | | | 11 | 14 | 13 | 12 | | | |
| | 33 | | 11 | 10 | | | | | 12 | 15 | 14 | 13 | | | |
| | 34 | | 12 | 11 | 10 | | | | 13 | 16 | 15 | 14 | | | |
| | 35 | 10 | 13 | 12 | 11 | | | | 14 | 17 | 16 | 15 | | | |
| | 36 | 11 | 14 | 13 | 12 | | | | 15 | 18 | 17 | 16 | | | |
| | 37 | 12 | 15 | 14 | 13 | | | | 16 | 19 | 18 | 17 | | | |
| | 38 | 13 | 16 | 15 | 14 | | | | 17 | 20 | 19 | 18 | | | |
| | 39 | 14 | 17 | 16 | 15 | | | | 18 | 21 | 20 | 19 | | | |
| | 40 | 15 | 18 | 17 | 16 | | | | 19 | 22 | 21 | 20 | | | |
| | 41 | 16 | 19 | 18 | 17 | | | | 20 | 23 | 22 | 21 | | | |
| | 42 | 17 | 20 | 19 | 18 | | | | 21 | 24 | 23 | 22 | | | |
| | 43 | 18 | 21 | 20 | 19 | | | | 22 | 25 | 24 | 23 | | | |
| | 44 | 19 | 22 | 21 | 20 | | | | 23 | 26 | 25 | 24 | | | |
| | 45 | 20 | 23 | 22 | 21 | | | | 24 | 27 | 26 | 25 | | | |
| | 46 | 21 | 24 | 23 | 22 | | | | 25 | 28 | 27 | 26 | | | |
| | 47 | 22 | 25 | 24 | 23 | | | | 26 | 29 | 28 | 27 | | | |
| | 48 | 23 | 26 | 25 | 24 | | | | 27 | 30 | 29 | 28 | | | |

FIG. 19

EMBODIMENT NO. 5

| | step | OUTPUT | SECOND IMAGE FORMING APPARATUS | | | | | | CONNE-CTION | FIRST IMAGE FORMING APPARATUS | | | | | |
|---|---|---|---|---|---|---|---|---|---|---|---|---|---|---|---|
| | | | 21 | 22 | 23 | 24 | 25 | 26 | A | 11 | 12 | 13 | 14 | 15 | 16 |
| | 1 | | | | | | | | | 1 | | | | | |
| | 2 | | | | | | | | | | 1 | | | | |
| | 3 | | | | | | | | | 2 | | 1 | | | |
| | 4 | | | | | | | | | | 2 | | 1 | | |
| | 5 | | | | | | | | | 3 | | 2 | | 1 | |
| | 6 | | | | | | | | | | 3 | | 2 | | 1 |
| I | 7 | | | | | | | | | 1 | | 3 | | 2 | |
| | 8 | | | | | | | | | 4 | 1 | | 3 | | 2 |
| | 9 | | | | | | | | | 2 | 4 | 1 | | 3 | |
| | 10 | | | | | | | | 1 | 5 | 2 | 4 | | | 3 |
| | 11 | | 1 | | | | | | | 3 | 5 | 2 | 4 | | |
| | 12 | | | 1 | | | | | 2 | 6 | 3 | 5 | | 4 | |
| | 13 | | 2 | | 1 | | | | | | 6 | 3 | 5 | | 4 |
| | 14 | 1 | | 2 | | | | | 3 | 4 | | 6 | | 5 | |
| | 15 | | 3 | | 2 | | | | | 7 | 4 | | 6 | | 5 |
| | 16 | 2 | | 3 | | | | | | 5 | 7 | 4 | | 6 | |
| | 17 | | | | 3 | | | | 4 | 8 | 5 | 7 | | | 6 |
| | 18 | 3 | 4 | | | | | | | 6 | 8 | 5 | | | |
| | 19 | | | 4 | | | | | 5 | 7 | 6 | 8 | | | |
| | 20 | | 5 | | 4 | | | | | 8 | 7 | 6 | | | |
| | 21 | 4 | | 5 | | | | | 6 | 9 | 8 | 7 | | | |
| | 22 | | 6 | | 5 | | | | 7 | 10 | 9 | 8 | | | |
| II | 23 | 5 | 7 | 6 | | | | | 8 | 11 | 10 | 9 | | | |
| | 24 | | 8 | 7 | 6 | | | | 9 | 12 | 11 | 10 | | | |
| | 25 | 6 | 9 | 8 | 7 | | | | 10 | 13 | 12 | 11 | | | |
| | 26 | 7 | 10 | 9 | 8 | | | | 11 | 14 | 13 | 12 | | | |
| | 27 | 8 | 11 | 10 | 9 | | | | 12 | 15 | 14 | 13 | | | |
| | 28 | 9 | 12 | 11 | 10 | | | | 13 | 16 | 15 | 14 | | | |
| | 29 | 10 | 13 | 12 | 11 | | | | 14 | 17 | 16 | 15 | | | |
| | 30 | 11 | 14 | 13 | 12 | | | | 15 | 18 | 17 | 16 | | | |
| | 31 | 12 | 15 | 14 | 13 | | | | 16 | 19 | 18 | 17 | | | |
| | 32 | 13 | 16 | 15 | 14 | | | | 17 | 20 | 19 | 18 | | | |
| | 33 | 14 | 17 | 16 | 15 | | | | 18 | 21 | 20 | 19 | | | |
| | 34 | 15 | 18 | 17 | 16 | | | | 19 | 22 | 21 | 20 | | | |
| | 35 | 16 | 19 | 18 | 17 | | | | 20 | 23 | 22 | 21 | | | |
| | 36 | 17 | 20 | 19 | 18 | | | | 21 | 24 | 23 | 22 | | | |
| | 37 | 18 | 21 | 20 | 19 | | | | 22 | 25 | 24 | 23 | | | |
| | 38 | 19 | 22 | 21 | 20 | | | | 23 | 26 | 25 | 24 | | | |
| | 39 | 20 | 23 | 22 | 21 | | | | 24 | 27 | 26 | 25 | | | |
| | 40 | 21 | 24 | 23 | 22 | | | | 25 | 28 | 27 | 26 | | | |
| | 41 | 22 | 25 | 24 | 23 | | | | 26 | 29 | 28 | 27 | | | |
| | 42 | 23 | 26 | 25 | 24 | | | | 27 | 30 | 29 | 28 | | | |
| | 43 | 24 | 27 | 26 | 25 | | | | 28 | 31 | 30 | 29 | | | |
| | 44 | 25 | 28 | 27 | 26 | | | | 29 | 32 | 31 | 30 | | | |
| | 45 | 26 | 29 | 28 | 27 | | | | 30 | 33 | 32 | 31 | | | |
| | 46 | 27 | 30 | 29 | 28 | | | | 31 | 34 | 33 | 32 | | | |
| | 47 | 28 | 31 | 30 | 29 | | | | 32 | 35 | 34 | 33 | | | |
| | 48 | 29 | 32 | 31 | 30 | | | | 33 | 36 | 35 | 34 | | | |

IMAGE FORMING SYSTEM AND CONTROL APPARATUS UTILIZING DUAL IMAGE FORMING APPARATUSES

BACKGROUND OF THE INVENTION

1. Field of the Invention

The present invention relates to a connected image forming system for performing image forming by connecting a plurality of image forming apparatuses.

2. Description of the Related Art

In recent years, demands for high speed, high image quality, color print, low energy consumption, and the like have become increasingly high for image forming apparatuses such as copying machines, printers, and multifunctional peripherals. For such electrophotographic image forming apparatuses, a tandem image forming apparatus has been proposed in which relay units that convey a printing material are provided between a plurality of image forming apparatuses to perform image forming. In this type of image forming apparatuses, each apparatus has charging, exposure, developing, transfer, and fixing devices. A first image forming apparatus forms an image on one side (first side) of a printing material, and inverts the printing material. Then, a next image forming apparatus forms an image on the other side (second side) of the printing material. There has been proposed a technique for doubling the number of output pages of double-sided printing as compared with the number of output pages of one conventional image forming apparatus by sharing an image forming operation, thereby achieving higher speed.

By connecting, using relay units, a plurality of image forming apparatuses each of which is usable by itself, it is possible to readily commercially introduce such connected image forming apparatuses without newly designing hardware. Unlike a scheme of making use of image forming apparatuses by connecting them in parallel, such connected image forming apparatuses can include a large-capacity sheet feed deck, post-processing device, and the like upstream or downstream, thereby advantageously sharing peripheral applications, facilitating inline processing, saving space, and reducing the introduction cost.

According to, for example, U.S. Pat. No. 4,579,446, connected image forming apparatuses are characterized by connecting two image forming apparatuses in series to have an inversion unit therebetween, and cause the apparatuses to respectively print front and back sides, thereby implementing double-sided printing.

The above connected image forming apparatuses have the following problem. That is, in U.S. Pat. No. 4,579,446, if one of the two apparatuses connected in series enters a state that is disabling for image forming such as a toner shortage state, it becomes impossible to continue an image forming operation. Therefore when only one of the apparatuses stops, a printing operation itself also stops. In addition to a toner shortage state, when printing materials run out, an image forming operation stops.

Connected image forming apparatuses which are used by connecting two image forming apparatuses have been mainly desired in the POD market such as a quick printing field requiring productivity. In such a market, a large amount of output and continuous operation is needed. Therefore, for example, it is required that even if an operator were to go home during a 24-hour operation, it should be possible to have continuous operation unattended until the next morning.

In connected image forming apparatuses, when one main body of the apparatuses enters an image forming disable state such as a toner or printing material shortage state, it is possible to switch control to continue a printing operation using the other normal main body, thereby continuing the printing operation. By performing the above control, however, one image forming apparatus stops image forming and the other image forming apparatus continues image forming. When the image forming apparatus which stopped image forming recovers an image forming enable state by maintenance processing performed by an operator, the productivity may decrease depending on the timing when the double-sided image forming operation by two apparatuses resumes.

SUMMARY OF THE INVENTION

The present invention proposes a control method for causing a connected image forming apparatus to smoothly recover an original connected image forming state from a state in which one image forming apparatus cannot perform image forming and the other image forming apparatus continues image forming. By applying the control method of the present invention, it is possible to properly execute productivity recovery.

According to one aspect of the present invention, there is provided an image forming system in which a first image forming apparatus and a second image forming apparatus downstream of the first image forming apparatus are connected, comprising: a switching unit configured to switch between a first mode in which the second image forming apparatus forms images on first and second sides of a sheet and a second mode in which the first image forming apparatus forms an image on a first side of a sheet and the second image forming apparatus forms an image on a second side of the sheet; and a control unit configured to control at least one of the first image forming apparatus and the second image forming apparatus so that when switching from the first mode in which the second image forming apparatus forms images on first and second sides of a sheet to the second mode in which the first image forming apparatus forms an image on a first side of a sheet and the second image forming apparatus forms an image on a second side of the sheet, if the second image forming apparatus is unable to perform image forming on a second side of a sheet whose first side has undergone image forming in the second image forming apparatus before the second image forming apparatus performs image forming on a second side of a sheet whose first side has undergone image forming in the first image forming apparatus, an order of the sheet whose first and second sides undergo image forming in the second image forming apparatus and the sheet whose first side undergoes image forming in the first image forming apparatus and whose second side undergoes image forming in the second image forming apparatus is not swapped.

According to another aspect of the present invention, there is provided a control apparatus which controls a first image forming apparatus and a second image forming apparatus connected downstream of the first image forming apparatus, wherein the control apparatus controls at least one of the first image forming apparatus and the second image forming apparatus so that when switching from a first mode in which the second image forming apparatus forms images on first and second sides of a sheet to a second mode in which the first image forming apparatus forms an image on a first side of a sheet and the second image forming apparatus forms an image on a second side of the sheet, if the second image forming apparatus is unable to perform image forming on a second side of a sheet whose first side has undergone image forming in the second image forming apparatus before the second image forming apparatus performs image forming on a second side of a sheet whose first side has undergone image forming in the first image forming apparatus, an order of the sheet whose first and second sides undergo image forming in the second image forming apparatus and the sheet whose first side undergoes image forming in the first image forming apparatus and whose second side undergoes image forming in the second image forming apparatus is not swapped.

According to the present invention, there is an operation mode in which a plurality of image forming units are used to form an image, and an operation mode in which only one image forming unit is used to form an image. According to the present invention, it is possible to obtain the following effects in a connected image forming apparatus which can continue an output operation even when one image forming apparatus cannot operate although the productivity decreases. That is, when the one image forming apparatus returns to an operable state, and the connected image forming apparatus performs a normal connected image forming operation to recover a state in which the productivity is high from a state in which the productivity is low, it is possible to smoothly recover the productivity without stopping the continuous operation of the main body. Furthermore, when recovering from an image forming disable state, the entire image forming apparatus can continue image forming again.

Further features of the present invention will become apparent from the following description of exemplary embodiments (with reference to the attached drawings).

BRIEF DESCRIPTION OF THE DRAWINGS

FIG. 11 is a table showing temporal changes in conveying states of printing sheets according to a conventional example;

FIG. 12 is a table showing temporal changes in conveying states of printing sheets according to the first embodiment;

FIG. 13 is a table showing temporal changes in conveying states of printing sheets according to the first embodiment;

FIG. 14 is a table showing temporal changes in conveying states of printing sheets according to the first embodiment;

FIG. 17 is a table showing temporal changes in conveying states of printing sheets according to a conventional example;

FIG. 18 is a table showing temporal changes in conveying states of printing sheets according to the second embodiment;

FIG. 19 is a table showing temporal changes in conveying states of printing sheets according to the second embodiment;

DESCRIPTION OF THE EMBODIMENTS

First Embodiment

[Overview of Connected Image Forming Apparatus]

Figure 1:
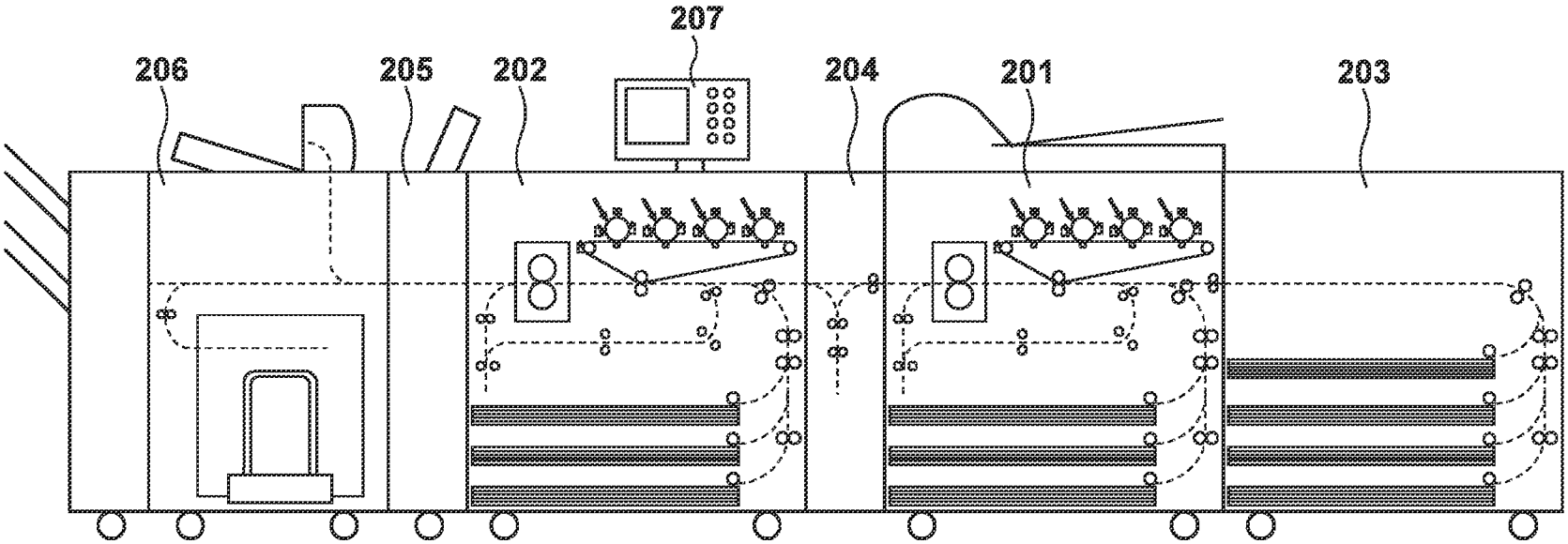
FIG. 1 is a schematic view showing a connected image forming apparatus.

FIG. 1 is a view showing the schematic configuration of a connected image forming apparatus serving as an image forming system according to this embodiment. A first image forming apparatus 201 and a second image forming apparatus 202, which are the same type, and a relay unit 204 constitute an image forming section. That is, two image forming apparatuses are included in this embodiment. A large-capacity sheet feed deck 203 capable of accommodating a large number of printing sheets is arranged upstream of the image forming section. On the other hand, an inserter 205 is arranged downstream of the image forming section, and a large-capacity stacker 206 is also arranged downstream of the inserter 205. There is provided, on the second image forming apparatus 202, an external display device 207 for executing an image forming operation.

The large-capacity sheet feed deck 203 can accommodate sheets the number of which is larger than that of sheets which are accommodated by sheet feed cassettes provided in the main body of the first image forming apparatus 201 or second image forming apparatus 202. In this embodiment, the sheet feed cassettes of the first image forming apparatus 201 or second image forming apparatus 202 include two cassettes each of which can accommodate one pack of 500 A3 sheets having a sheet weight of 80 g/m$^2$, and one cassette which can accommodate two packs, that is, 1,000 sheets. That is, the sheet feed cassettes can accommodate 2,000 sheets in total. On the other hand, the large-capacity sheet feed deck 203 includes four cassettes each of which can accommodate 2,000 sheets. That is, the large-capacity sheet feed deck 203 can accommodate 8,000 sheets in total. Although only one large-capacity sheet feed deck 203 is shown in FIG. 1, it is possible to accommodate a larger number of sheets by adding a plurality of large-capacity sheet feed decks 203 upstream of the large-capacity sheet feed deck 203.

The connected image forming apparatus of this embodiment can perform double-sided output of 2,100 A3 sheets per hour. Therefore, if one large-capacity sheet feed deck 203 is provided, the apparatuses can continuously operate for three hours or more. If four or more large-capacity sheet feed decks 203 are connected, a 15-hour continuous operation is possible. Although only one large-capacity stacker 206 is shown, it is possible to add a plurality of large-capacity stackers 206 downstream. The capacity of the large-capacity stacker 206 is 8,000 A3 sheets, which corresponds to the capacity of one large-capacity sheet feed deck 203. If, therefore, large-capacity stackers 206 the number of which is the same as that of large-capacity sheet feed decks 203 are added, an unattended continuous operation is possible until all sheets run out. The specifications of the above-described image forming apparatuses are merely an example. The number of sheets which can be accommodated and the number of large-capacity sheet feed decks 203 or large-capacity stackers 206 which can be arranged are not limited to those mentioned above, and may be increased or decreased as needed.

[Overview of Image Forming Unit]

Figure 2:
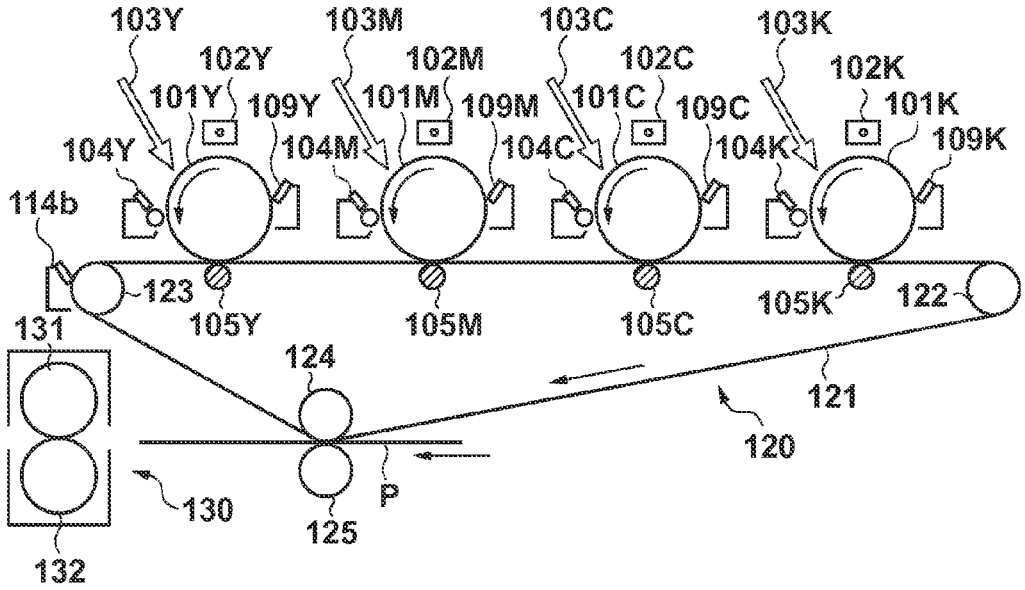
FIG. 2 is a schematic view showing an image forming unit of an image forming apparatus.

FIG. 2 is a schematic view showing an image forming unit of the connected image forming apparatus to which the present invention is applicable, and a description thereof will be given below. As shown in FIG. 2, the image forming unit of the connected image forming apparatus to which the present invention is applicable has four image forming stations Y, M, C, and K each having a photosensitive drum 101 (101Y, 101M, 101C, or 101K) as an electrostatic latent image carrier. An intermediate transfer device 120 is arranged below the image forming stations. The intermediate transfer device 120 is configured so that an intermediate transfer belt 121 serving as an intermediate transfer member loops around rollers 122, 123, and 124 to travel in a direction shown by an arrow.

In this embodiment, the surface of each photosensitive drum 101 charged by a corresponding corona charge type charger 102 (102Y, 102M, 102C, or 102K) serving as a noncontact charging member is exposed to a corresponding semiconductor laser 103 (103Y, 103M, 103C, or 103K) driven by a laser driver (not shown), thereby forming an electrostatic latent image on the photosensitive drum 101. A corresponding developing device 104 (104Y, 104M, 104C, or 104K) develops this electrostatic latent image to form a yellow, magenta, cyan, or black toner image.

The toner image formed in each image forming station is transferred and superimposed on the intermediate transfer belt 121 made of a polyimide resin by a transfer bias of a corresponding transfer roller 105 (105Y, 105M, 105C, or 105K) serving as a primary transfer means. A four-color toner image formed on the intermediate transfer belt 121 is transferred to a printing sheet P by a secondary transfer roller 125 serving as a secondary transfer means arranged to oppose the roller 124. The toner remaining on the intermediate transfer belt 121, without being transferred to the printing sheet P, is removed by an intermediate transfer belt cleaner 114*b*. When the toner image is transferred to the printing sheet P, the printing sheet P undergoes pressing/heating by a fixing device 130 including fixing rollers 131 and 132, thereby obtaining a permanent image. The primary transfer residual toner which remains on the photosensitive drum 101 after transfer to the intermediate transfer belt 121 is removed by a corresponding cleaning device 109 (109Y, 109M, 109C, or 109K). Each component of the image forming unit prepares for a next image forming operation.

[Details of Each Component of Image Forming Unit]

Each component of the image forming unit will be described in more detail next.

[Electrostatic Latent Image Carrier]

The image forming unit according to this embodiment includes, as an electrostatic latent image carrier, a rotating drum type electrophotographic photosensitive member, that is, the photosensitive drum 101.

[Charger]

In this embodiment, the corona chargers (to be simply referred to as "chargers" hereinafter) 102Y to 102K serving as noncontact charging members are arranged as charging means. The charger 102 has a charging wire (corona discharge electrode), grid electrode, and shield case (none are shown). An external power supply is connected to the charging wire via a charging wire bias application circuit. A charging wire bias (charging wire high voltage) is applied to the charging wire to generate a corona discharge, thereby charging the photosensitive drum 101. An information integrated circuit serving as a control unit controls conditions of the charging wire bias application circuit such as a charging wire bias ON/OFF timing and an output value.

For a charge which has generated a corona discharge by the charging wire, a grid bias (grid high voltage) to be applied to the grid electrode connected with a constant voltage power supply is controlled. With this operation, a charge amount to be supplied to the photosensitive drum 101 serving as a charged member is adjusted to control the charge potential of the photosensitive drum 101.

The constant voltage power supply (grid bias application power supply) serving as a grid bias output means applies an arbitrary negative voltage to the grid electrode. This operation controls the charge potential of the photosensitive drum 101 serving as a charged member. The information integrated circuit serving as a control unit controls conditions of the grid bias application power supply such as a grid bias ON/OFF timing and an output value.

[Exposure Device]

An exposure device according to this embodiment includes a semiconductor laser 103 for performing, based on image information, image exposure for the photosensitive drum 101 whose surface has been equally charged by the charger 102. Note that this embodiment has been described using a semiconductor laser but another means such as an LED may be used.

[Developing Device]

The developing device 104 according to this embodiment includes a developing container which stores two-component developer as a mixture of non-magnetic toner and a magnetic carrier, and a developing sleeve which is rotatably arranged at the opening of the developing container. The toner is brought into slidable contact with the magnetic carrier to be frictionally charged negatively.

The developing sleeve has a function of magnetically holding the developer within the developing container using a magnet fixed within the developing sleeve, and conveying the developer to the developing device 104 at a gap with the photosensitive drum 101. Furthermore, the developing sleeve is connected with a developing power supply for applying a developing bias obtained by superimposing a DC voltage (−600 V) on an AC voltage (Vpp is 1,800 V). This developing bias causes toner to adhere to an electrostatic latent image, thereby executing developing processing. A high-voltage control unit (not shown) controls this developing power supply.

[Transfer Device]

The transfer device according to this embodiment includes the intermediate transfer belt 121 looping around a plurality of suspension rollers, and the transfer rollers 105 arranged to oppose the respective photosensitive drums 101 with respect to the intermediate transfer belt 121. A region where the intermediate transfer belt 121 and each photosensitive drum 101 are in press contact with each other by the corresponding transfer roller 105 serves as a transfer portion.

Each transfer roller 105 is connected with a transfer power supply for applying a transfer bias with a polarity opposite to the normal charging polarity (negative) of toner. A toner image formed on each photosensitive drum 101 by the transfer bias is transferred to the intermediate transfer belt 121. The high-voltage control unit (not shown) of the control unit controls the transfer power supply. After that, the toner image transferred to the intermediate transfer belt 121 is transferred to the printing sheet P by the secondary transfer roller 125 serving as a secondary transfer means arranged to oppose the roller 124 of the intermediate transfer belt 121.

[Cleaning Device]

Each cleaning device 109 cleans the surface of the corresponding photosensitive drum 101. Each cleaning device 109 includes a fur brush and cleaning blade (not shown) for removing toner remaining on the corresponding photosensitive drum 101. The removed toner is stored in a reclaim container (not shown).

[Fixing Device]

The fixing device 130 of this embodiment includes the fixing roller 131 serving as a heating member of a toner image, and the fixing roller 132 (pressurizing roller) serving as a pressurizing member. The fixing roller 131 is rotatably driven in a predetermined direction at a certain speed by a driving source (not shown).

A thermistor (not shown) serving as a temperature detection means detects the surface temperature of the fixing roller 131. The control unit controls ON/OFF of a halogen heater based on the detected temperature, thereby controlling the temperature to be a predetermined target temperature, for example, 200° C. In this case, a temperature detection means detects the surface temperature of the pressurizing roller 132. The control unit controls ON/OFF of a halogen heater based on the detected temperature, thereby controlling the temperature to be a predetermined target temperature, for example, 150° C.

The schematic configuration of the image forming unit within the image forming apparatus has been explained. Although the YMCK color image forming apparatus has been described in this embodiment, the present invention is not limited to this, and may be applied to a monochrome image forming apparatus or the like.

[System Configuration]

Figure 3:
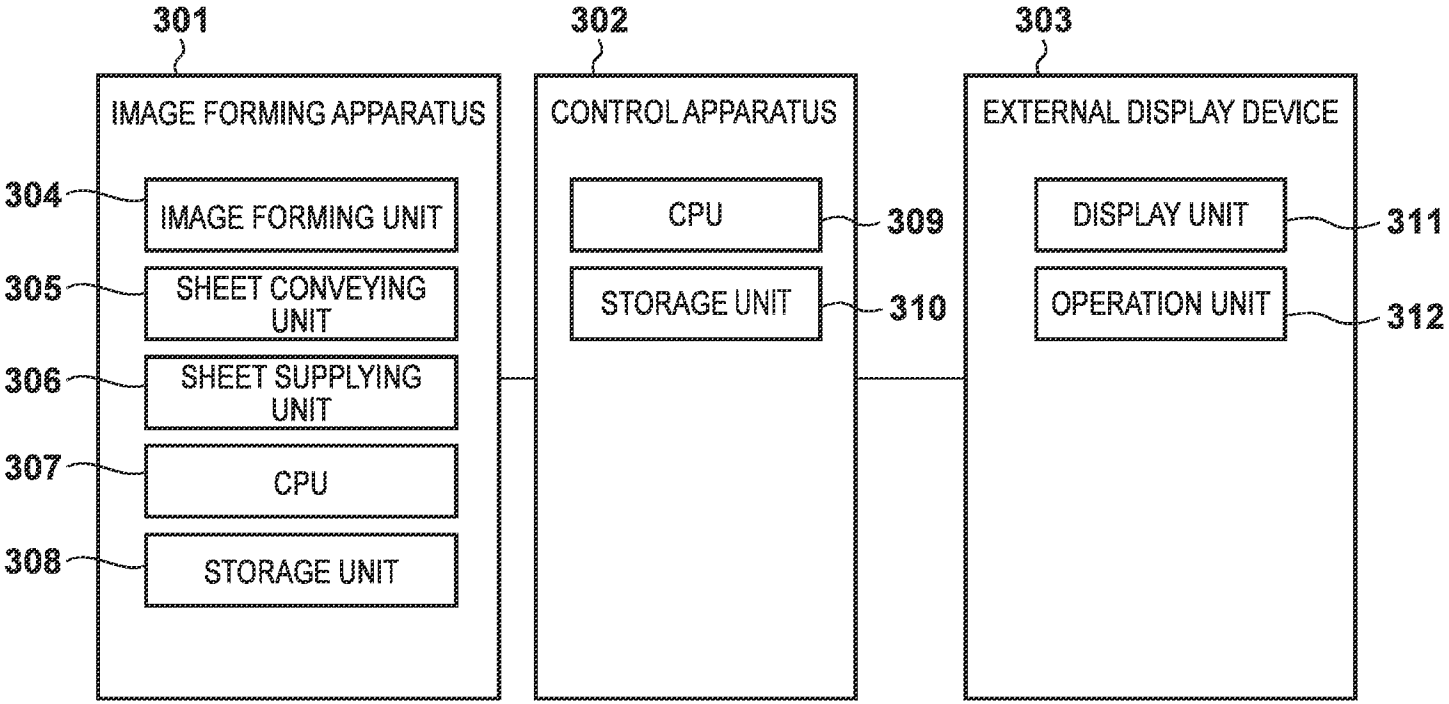
FIG. 3 is a control block diagram of the image forming apparatus.

Each of the above-described basic constituent units is connected to a control apparatus 302 as shown in a control block diagram of FIG. 3, and is regulated and controlled by instructions from the control apparatus 302. The control apparatus 302 implements a switching control means and recovery control means. Note that an image forming apparatus 301 of FIG. 3 is defined as an integration of the components 201 to 206 shown in FIG. 1.

The image forming apparatus 301 is connected with the control apparatus 302 via an input/output interface. A CPU 307 of the image forming apparatus 301 and an external display device 303 are connected with each other via a circuit within a CPU 309 of the control apparatus 302. The control apparatus 302 includes an external input/output interface (not shown) for externally receiving image data. The CPU 309 of the control apparatus 302 determines which of the first image forming apparatus 201 and second image forming apparatus 202 becomes an image data transmission destination. The input/output interface corresponds to, for example, a connection jack for a LAN (Local Area Network) cable, and is input with a print instruction or job from a terminal such as a PC or workstation via a network.

An image forming unit 304 of the image forming apparatus 301 performs image exposure for the photosensitive drum 101, charging, developing by using toner, and transferring toner image to a sheet according to instruction from the control apparatus 302. Specifically, above-mentioned processing is performed by the photosensitive drum 101, the charger 102, the semiconductor laser 103, the developing device 104, and the transfer rollers 105 as shown in FIG. 2. A sheet conveying unit 305 conveys a sheet supplied from a sheet supplying unit 306. The sheet conveying unit 305 corresponds to rollers, the intermediate transfer belt 121, the roller 124, and the like as shown in FIG. 1 and FIG. 2. The sheet supplying unit 306 corresponds to the large-capacity sheet feed deck 203, and the like as shown in FIG. 1.

In this embodiment, the external display device 303 is arranged on a panel which is placed on the image forming unit of the second image forming apparatus 202, and indicates the external display device 207 of FIG. 1. The external display device 207 includes a display unit 311 and operation unit 312. The external display device 207 includes ten-key buttons (not shown) for inputting a numerical value, and is used by a user or operator to instruct the number of printing sheets and a printing operation. The configuration of the external display device 207 will be described below.

Figure 4A:
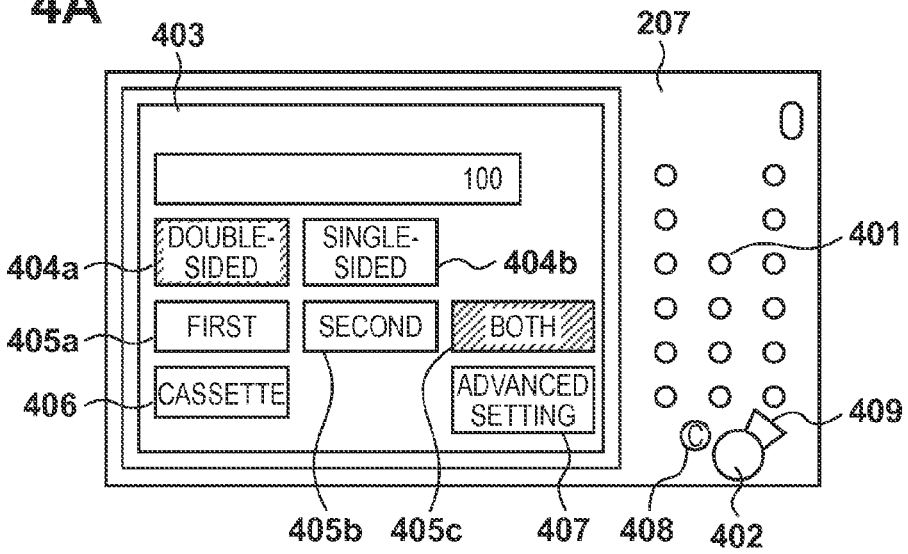
FIGS. 4A, 4B, and 4C are views showing display examples of an external display device of the image forming apparatus.

FIG. 4A shows the schematic configuration of the external display device 207. Ten-key buttons 401 are used to input a numerical value for designating the number of printing sheets. A clear button 408 is used to cancel the number of sheets input using the ten-key buttons 401. A reset button 409 is used to reset all settings. A start button 402 is used to send a print start instruction. When the start button 402 is pressed, the control apparatus 302 reads print settings such as the number of sheets and a cassette set through the external display device 207, and then starts a printing operation (to be described later).

A liquid crystal touch panel 403 is a touch panel liquid crystal monitor, and is capable of displaying information and inputting information by panel touch. The touch panel 403 implements an acceptance means. Print setting buttons 404*a* and 404*b* are used to select and set single- or double-sided printing of output sheets. As an initial value, the highlighted print setting button 404*a* ("double-sided") has been selected. To designate single-sided printing, the user touches the print setting button 404*b* ("single-sided") to switch the highlighted portion, thereby designating single-sided printing.

Image forming setting buttons 405*a*, 405*b*, and 405*c* are used to select and set whether only the first image forming apparatus 201, only the second image forming apparatus 202, or both of them are used to execute a printing operation. In initial setting, the image forming setting button 405*c* is selected to set that both the image forming apparatuses 201 and 202 are used to execute a printing operation. Control of each setting operation will be explained later.

Figure 4B:
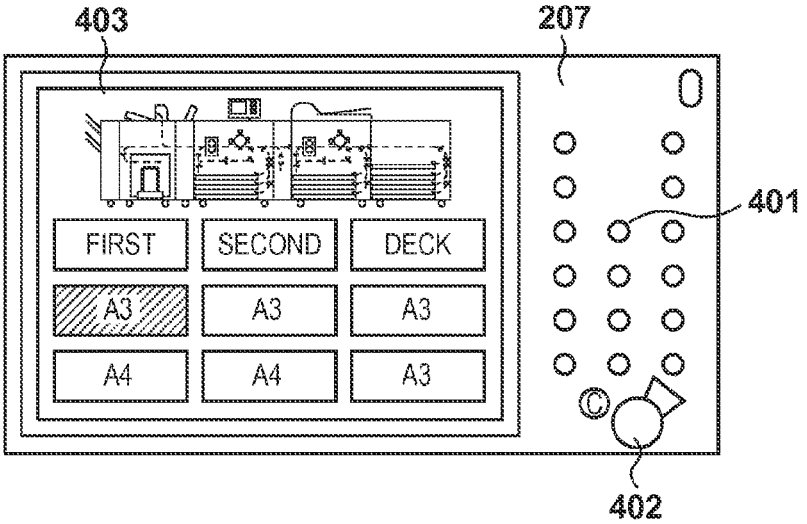
Figure 4C:
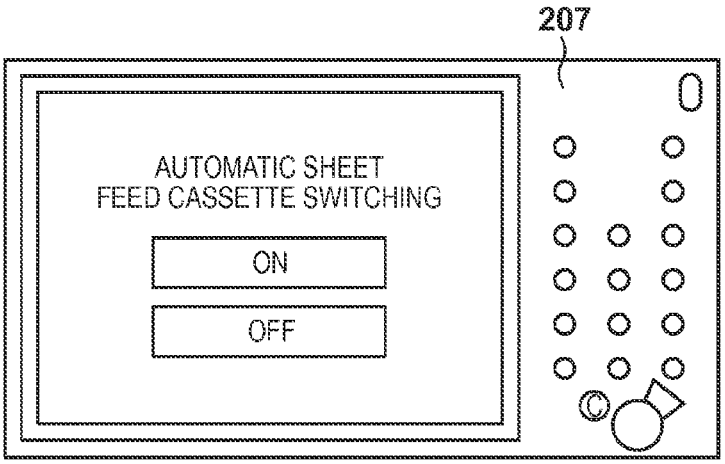

A cassette designation button 406 is used to designate a cassette which accommodates printing materials used for a printing operation. When the cassette designation button 406 is pressed, a cassette setting screen shown in FIG. 4B is displayed. The cassette setting screen enables to designate a settable cassette among cassettes which accommodate sheets. An advanced setting button 407 is used to make advanced print settings other than the above-described preferences. When the advanced setting button 407 is pressed, for example, a setting screen in FIG. 4C appears, that is, an automatic sheet feed cassette switching setting screen is displayed in this embodiment. Assume that the automatic sheet feed cassette switching setting is set to "ON". In this case, when the sheet feed cassette currently used in an image forming operation becomes empty, the sheet feed cassette is switched to another sheet feed cassette which accommodates sheets. As other setting conditions, print scale designation and various settings are possible. Settable items in FIGS. 4B and 4C are preset as initial values or preset by designation of an administrator or the like.

The print setting method has been explained using the operation panel of FIG. 4A. When a printing operation is instructed on a PC via an input interface, the setting areas of the above-described setting items are also arranged on a print setting screen displayed on the display of the PC. This makes it possible to set whether only the first image forming apparatus 201, only the second image forming apparatus 202, or both of them are used to perform printing.

[Image Forming Control of Connected Image Forming Apparatus]

A double-sided printing operation of the image forming apparatuses of this embodiment when whether only the first image forming apparatus 201, only the second image forming apparatus 202, or both of them are used to perform a printing operation is designated using an image forming setting button 405 (405*a*, 405*b*, or 405*c*) of the liquid crystal touch panel 403 will be described below. Note that the operation of flowcharts to be explained hereinafter is centrally controlled by the CPU 309 of the control apparatus 302 of FIG. 3, and the CPU 309 outputs a control instruction to the CPU 307 of the image forming apparatus 301 (that is, the CPU of each of the first and second image forming apparatuses). Assume that each CPU reads out and executes programs associated with the operation, which are stored in a storage unit 308.

(1) Control when Both Image Forming Apparatuses are Used

Figure 5:
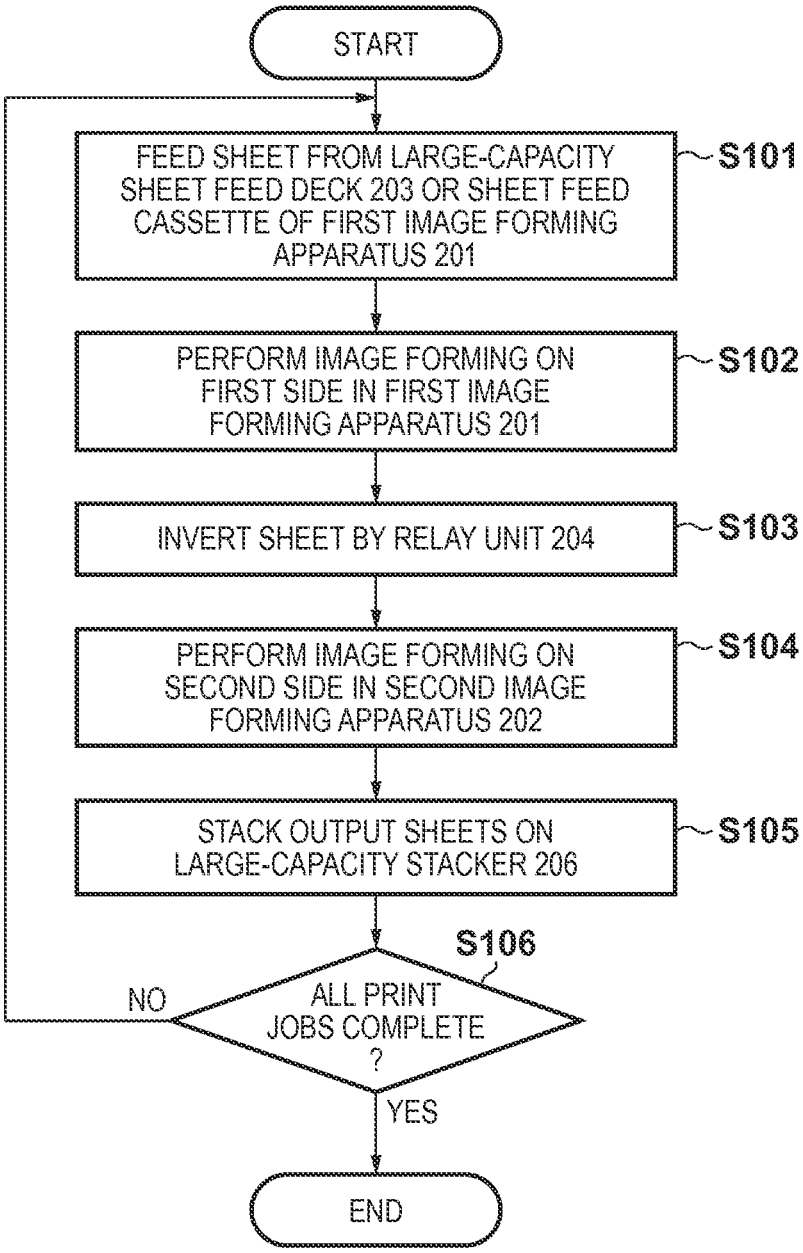
FIG. 5 is a flowchart illustrating a printing operation of the image forming apparatus.

Assume that in the connected image forming apparatus, both the image forming apparatuses are used to perform double-sided printing by sharing image forming, which is an initial setting. A flowchart associated with this case will be described first with reference to FIG. 5.

(S101): The CPU 309 causes the large-capacity sheet feed deck 203 or a sheet feed cassette of the first image forming apparatus 201 to feed a stored sheet. Note that the cassette which feeds a sheet has been designated by an operator through, for example, the interface shown in FIG. 4B.

(S102): The CPU 309 transfers a toner image formed by the first image forming apparatus 201 to the fed sheet, and causes the fixing device of the first image forming apparatus 201 to fix the image. With this operation, image forming is performed on the first side of the sheet.

(S103): The CPU 309 causes the relay unit 204 to switch-back convey the sheet whose first side has undergone image forming. The CPU 309 conveys, to the second image forming apparatus 202, the sheet whose front and back sides have been inverted. That is, the sheet whose first side has undergone image forming points downward and is conveyed to the second image forming apparatus 202.

(S104): The CPU 309 transfers a toner image formed by the second image forming apparatus 202 to the inverted sheet. The CPU 309 causes the fixing device of the second image forming apparatus 202 to fix the image, and to perform image forming on the second side of the sheet.

(S105): The CPU 309 stacks the sheet whose both sides have undergone image forming on the large-capacity stacker 206, and completes the printing operation. The large-capacity stacker 206 stacks, on itself, output printing materials in an output order.

(S106): After the current image forming operation ends, the CPU 309 determines whether image forming processing for all print jobs is complete. If there is an unprocessed print job, the process returns to step S101 to repeat the processing. If the image forming processing for all the print jobs is complete, the processing flow ends.

As described above, in a double-sided printing operation, setting both the image forming apparatuses to be used has a big advantage since a plurality of image forming apparatuses cooperate with each other, thereby doubling the productivity.

Consider a case in which a single-sided printing operation is performed using both the image forming apparatuses. In this case, an image obtained when the first image forming apparatus 201 or second image forming apparatus 202 performs image forming on a sheet is assumed to be a blank image (no image forming), and the same printing operation as that in steps S101 to S106 is then performed. This operation is the same as that for outputting a white sheet, and the image forming apparatus which executes an operation for a no image forming only conveys the sheet.

(2) Control when Only First Image Forming Apparatus 201 is Used

Figure 6:
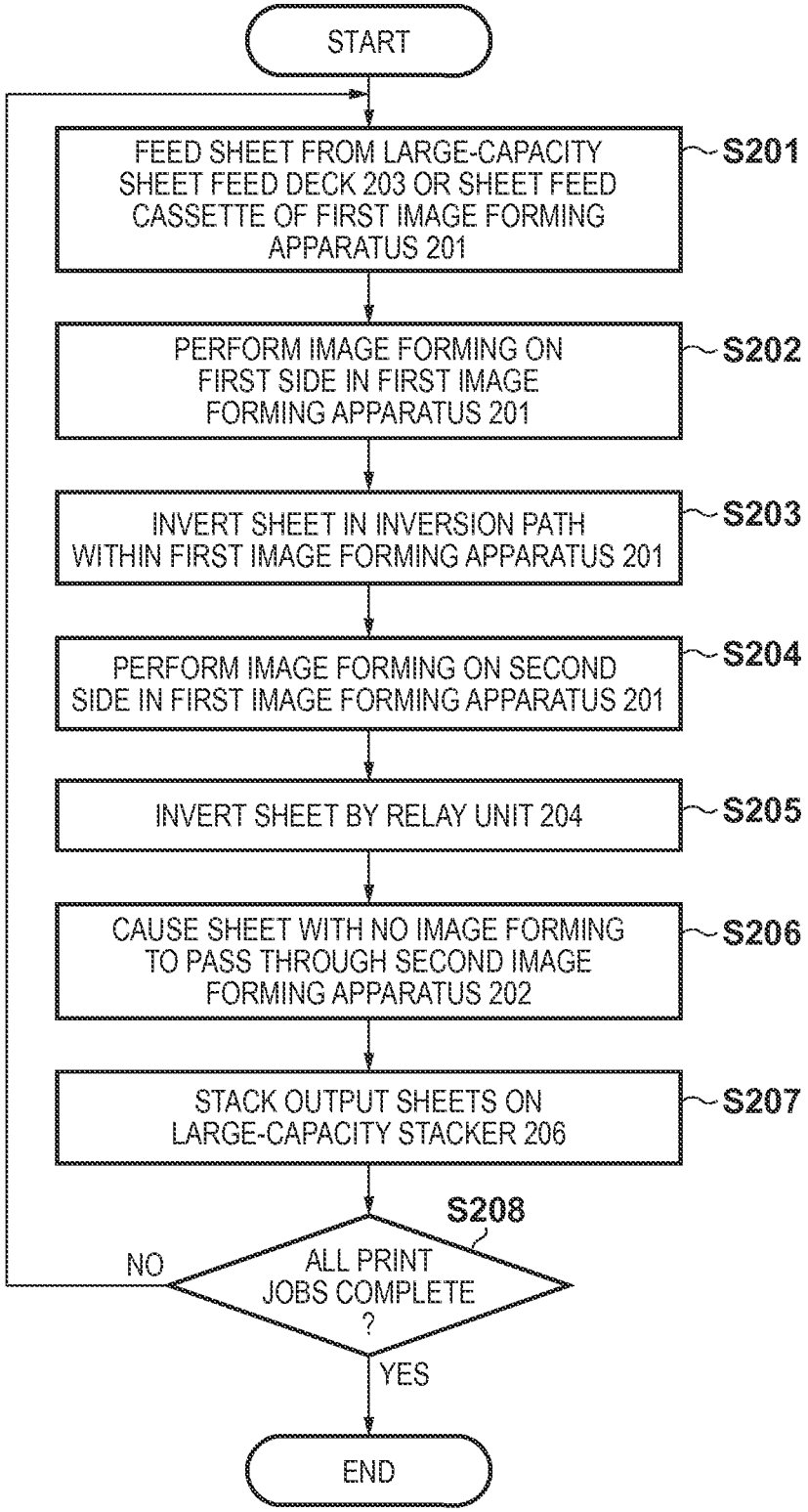
FIG. 6 is a flowchart illustrating a printing operation of the image forming apparatus.

A flowchart when the image forming setting button 405*a* ("first") shown in FIG. 4A is designated, that is, when a double-sided printing operation is performed using only the first image forming apparatus 201 arranged upstream in the connected image forming apparatus will be explained with reference to FIG. 6.

(S201): The CPU 309 causes the large-capacity sheet feed deck 203 or a sheet feed cassette of the first image forming apparatus 201 to feed a stored sheet. Note that the cassette which feeds a sheet has been designated by a user through, for example, the interface shown in FIG. 4B.

(S202): The CPU 309 transfers a toner image formed by the first image forming apparatus 201 to the fed sheet. The CPU 309 causes the fixing device of the first image forming apparatus 201 to fix the transferred toner image, thereby performing image forming on the first side of the sheet.

(S203): The CPU 309 feeds again, to the image forming unit of the first image forming apparatus 201, the sheet inverted by switch back by the inversion path unit of the first image forming apparatus 201.

(S204): The CPU 309 transfers a toner image formed by the first image forming apparatus 201 to the inverted sheet. The CPU 309 causes the fixing device of the first image forming apparatus 201 to fix the transferred toner image, thereby performing image forming on the second side of the sheet.

(S205): The CPU 309 causes the relay unit 204 to switch back the sheet, and to convey the inverted sheet to the second image forming apparatus 202.

(S206): The CPU 309 causes the sheet conveyed to the second image forming apparatus 202 to pass through without undergoing image forming. At this time, the CPU 309 sends a sheet conveying instruction, and the second image forming apparatus 202 only performs a sheet conveying operation without application of a high voltage for charging, developing, or transfer.

(S207): The operation is the same as that in step S105 of FIG. 5, and a description thereof will be omitted.

(S208): The operation is the same as that in step S106 of FIG. 5, and a description thereof will be omitted.

Assume that it is possible to set to enable a printing operation using only the first image forming apparatus 201, as described above. In this case, when only the second image forming apparatus 202 enters a printing operation disable state, the productivity halves but it is possible to continue a printing operation.

(3) Control when Only Second Image Forming Apparatus 202 is Used

Figure 7:
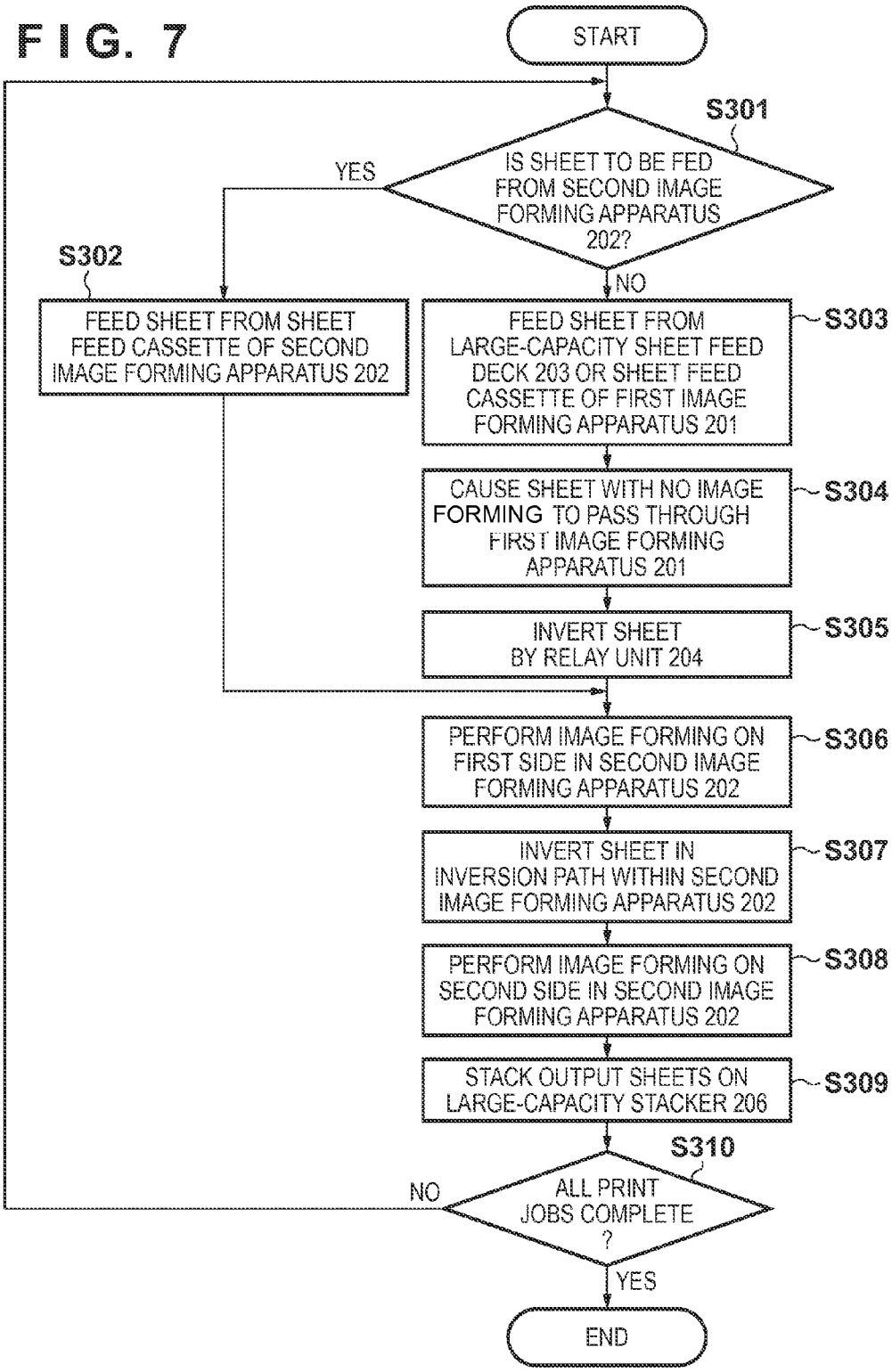
FIG. 7 is a flowchart illustrating a printing operation of the image forming apparatus.

A flowchart when the image forming setting button 405*b* ("second") shown in FIG. 4A is designated, that is, when an operation is performed using only the second image forming apparatus 202 arranged downstream in the connected image forming apparatus will be explained with reference to FIG. 7.

(S301): The CPU 309 determines which of the large-capacity sheet feed deck 203 and sheet feed cassettes of the first image forming apparatus 201 and second image forming apparatus 202 feeds a sheet. If the large-capacity sheet feed deck 203 or the sheet feed cassette of the first image forming apparatus 201 feeds a sheet (NO in step S301), the process advances to step S303. If the sheet feed cassette of the second image forming apparatus 202 feeds a sheet (YES in step S301), the process advances to step S302.

(S302): The CPU 309 causes the second image forming apparatus 202 to feed a sheet from its own sheet feed cassette according to a designated sheet feed instruction. The process then advances to step S306.

(S303): The CPU 309 causes the large-capacity sheet feed deck 203 or the sheet feed cassette of the first image forming apparatus 201 to feed a sheet according to a designated sheet feed instruction. The process then advances to step S304.

(S304): The CPU 309 causes the sheet conveyed to the first image forming apparatus 201 to pass through without undergoing image forming. At this time, the CPU 309 sends a sheet conveying instruction, and the first image forming apparatus 201 only performs a sheet conveying operation without application of a high voltage for charging, developing, or transfer.

(S305): The CPU 309 causes the relay unit 204 to switch back the sheet, and to convey the inverted sheet to the second image forming apparatus 202.

(S306): The CPU 309 transfers a toner image formed by the second image forming apparatus 202 to the sheet conveyed to the second image forming apparatus 202. The CPU 309 causes the fixing device of the second image forming apparatus 202 to fix the transferred toner image, thereby performing image forming on the first side of the sheet.

(S307): The CPU 309 feeds again, to the image forming unit of the second image forming apparatus 202, the sheet inverted by switch back by the inversion path of the second image forming apparatus 202.

(S308): The CPU 309 transfers a toner image formed by the second image forming apparatus 202 to the inverted sheet. The CPU 309 causes the fixing device of the second image forming apparatus 202 to fix the transferred toner image, thereby performing image forming on the second side of the sheet.

(S309): The operation is the same as that in step S105 of FIG. 5, and a description thereof will be omitted.

(S310): The operation is the same as that in step S106 of FIG. 5, and a description thereof will be omitted.

Assume that it is possible to set to enable a printing operation using only the second image forming apparatus 202, as described above. In this case, when only the first image forming apparatus 201 enters a printing operation disable state, the productivity is halved but it is possible to continue a printing operation.

As described above, the connected image forming apparatus to which the present invention is applicable performs control by connecting the first image forming apparatus 201 and the second image forming apparatus 202. It is also possible to perform a printing operation using only the first image forming apparatus 201 or second image forming apparatus 202. When one image forming apparatus enters a disabled state, for example, when toner runs out, a reclaim toner box becomes full, or sheets run out, conventional connected image forming apparatuses completely stop a printing operation. However, the connected image forming apparatus of this embodiment is able to continue a printing operation by designating the other usable image forming apparatus by the user though the productivity halves.

[Stop Avoidance Control of Connected Image Forming Apparatus]

Figure 8A:
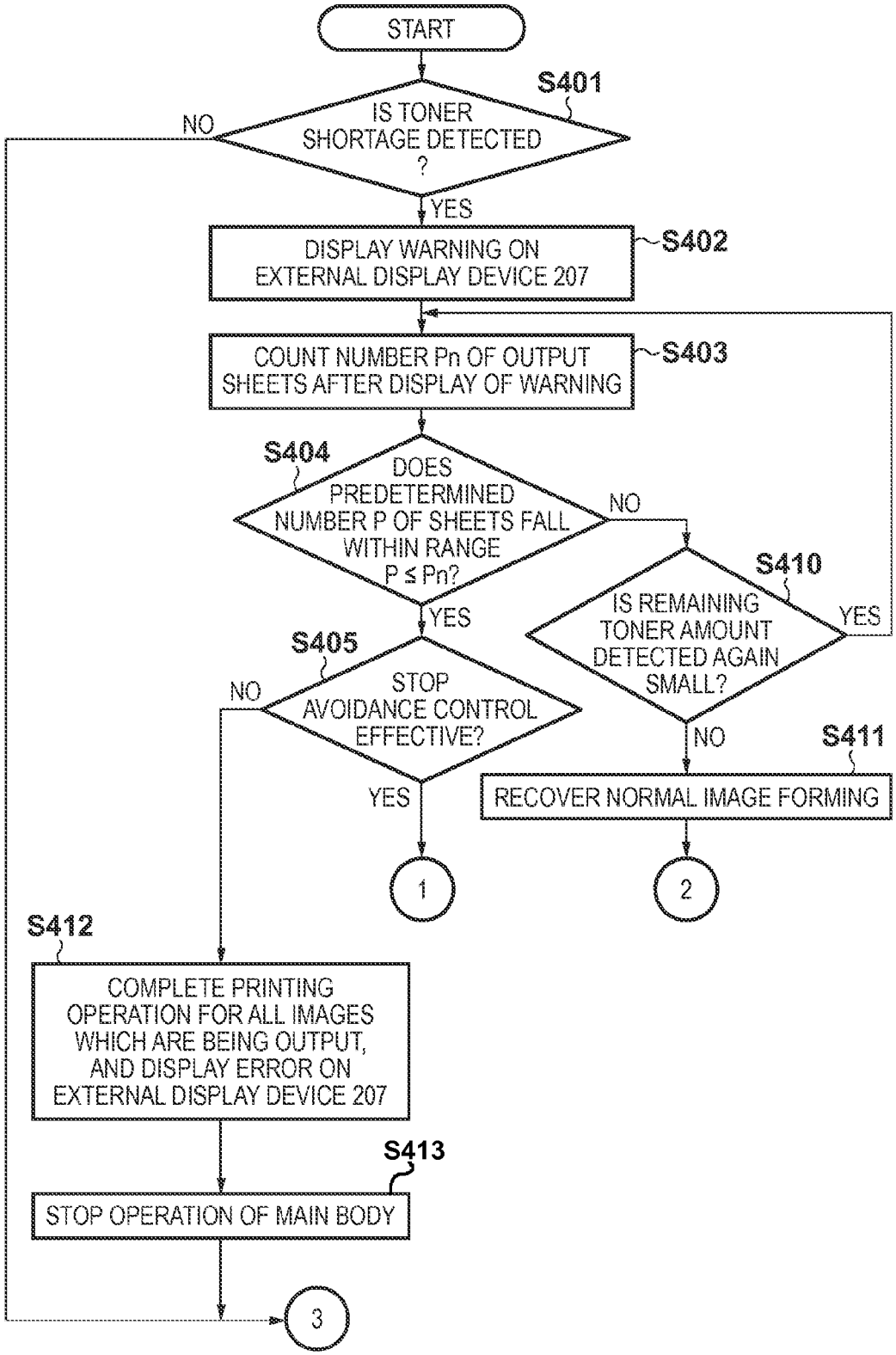
FIGS. 8A and 8B are flowcharts illustrating a printing operation of the image forming apparatus.
Figure 8B:
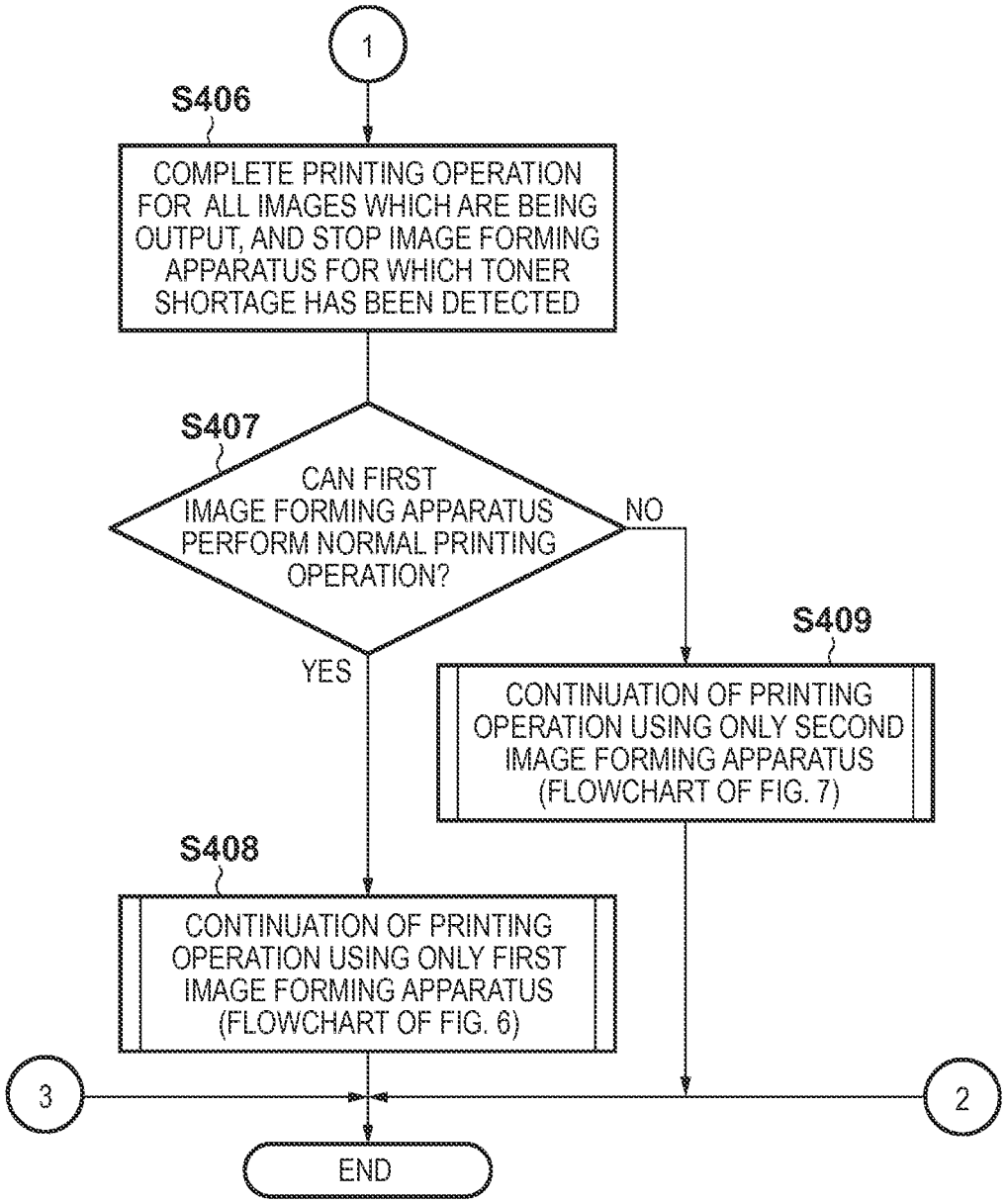

Control when the user designates an image forming apparatus to be used through the operation panel or the like (the user designates first/second/both using the image forming setting buttons) has been explained. The connected image forming apparatus to which the present invention is applicable may include automatic stop avoidance control, as will be described below. That is, the connected image forming apparatus may have control (stop avoidance control) which causes the control unit to automatically determine that one image forming apparatus stops because of toner shortage or the like, and to automatically switch to control using only an image forming apparatus capable of performing image forming. A control method of the automatic switching control for the connected image forming apparatus will be described in detail below. The above-mentioned stop avoidance control operation will be explained with reference to FIGS. 8A and 8B. To perform this process, assume that image forming is executed using both the first and second image forming apparatuses. Note that the operation of a flowchart to be described hereinafter is centrally controlled by the CPU 309 of the control apparatus 302 of FIG. 3, and the CPU 309 outputs a control instruction to the CPU 307 of the image forming apparatus 301 (that is, the CPU of each of the first and second image forming apparatuses). Assume that each CPU reads out and executes programs associated with the operation, which are stored in the storage unit.

(S401): The CPU 309 determines in image forming whether a remaining toner amount supplied from a toner supply bottle in one of the image forming apparatuses becomes small and a remaining toner amount detection sensor (not shown) detects that the remaining toner amount is smaller than a predetermined amount. The predetermined amount is determined based on a predefined value for toner of the toner supply bottle. If the sensor detects that the remaining toner amount is small (YES in step S401), the process advances to step S402; otherwise (NO in step S401), the stop avoidance control ends. Note that if the stop avoidance control ends, the connected image forming apparatus uses both the first image forming apparatus 201 and second image forming apparatus 202 to continuously perform a printing operation.

Figure 9A:
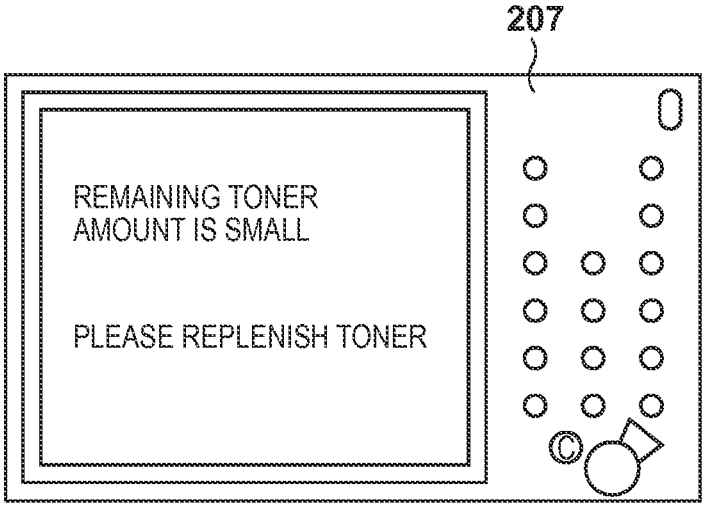
FIGS. 9A and 9B are views showing display examples of the external display device of the image forming apparatus.

(S402): If the remaining toner amount detection sensor detects that the remaining toner amount is small, the CPU 309 causes the external display device 207 to display a warning (using, for example, a display method shown in FIG. 9A), thereby encouraging the operator to supply toner.

(S403): The CPU 309 stores, in a storage unit 310, the number Pn of output sheets after display of the toner supply warning.

(S404): The CPU 309 determines whether the number Pn of output sheets stored in step S403 is equal to or larger than a predetermined number P of sheets. The predetermined number P of sheets represents the number of sheets which can be output until toner completely runs out after the image forming apparatus displays the toner supply warning. The predetermined number P of sheets varies depending on the sheet size, images to be formed, and the like. In the image forming apparatus of this embodiment, when images with a standard density are formed, 2,000 A3 sheets (=about 1 hour if converted to an image forming time) can be output in single-sided printing. Although a method of counting output sheets is used to determine whether toner completely runs out in this embodiment, a method of making determination using a sensor which detects that toner completely runs out, or a method of accumulating video count values of output images may be used.

(S405): If the CPU 309 determines in step S404 that the number Pn of output sheets after display of the toner supply warning is equal to or larger than the predetermined number P of sheets (YES in step S404), it determines whether the stop avoidance control is effective (the user can set using the advanced setting button 407). If the stop avoidance control is effective (YES in step S405), the process advances to step S406; otherwise (NO in step S405), the process advances to step S412.

(S406): If the CPU 309 determines in step S405 that the stop avoidance control is effective (YES in step S405), it completes a printing operation (including sheet output) for all images which are being output, and stops the image forming apparatus whose remaining toner amount has been detected to be small. Whether the remaining toner amount is large or small is determined based on the predefined value for toner of the bottle. The process then advances to step S407.

(S407): After the CPU 309 stops the image forming apparatus whose remaining toner amount is small in step S406, it determines whether the first image forming apparatus 201 can perform a printing operation. If the first image forming apparatus 201 can perform a normal printing operation (YES in step S407), the process advances to step S408; otherwise (NO in step S407), the process advances to step S409. The expression "normal printing operation" represents a printing operation when an error such as toner shortage or sheet shortage has not occurred in the image forming apparatus. In this state, the image forming apparatus can execute a printing operation without any restriction imposed by an error.

(S408): If the CPU 309 determines in step S407 that the first image forming apparatus 201 can perform a printing operation (that is, toner of the second image forming apparatus 202 has run out), it continues the printing operation using only the first image forming apparatus 201 according to the flowchart illustrated in FIG. 6. Then, the processing flow ends.

(S409): If the first image forming apparatus 201 cannot perform a normal printing operation because toner has run out (NO in step S407), the CPU 309 continues the printing operation using only the second image forming apparatus 202 according to the flowchart illustrated in FIG. 7. Then, the processing flow ends.

(S410): If the number Pn of output sheets after display of the toner supply warning is smaller than the predetermined number P of sheets (No in step S404), the CPU 309 causes the remaining toner amount detection sensor to detect the remaining toner amount again. If the remaining toner amount is still small (YES in step S410), the process returns to step S403. Assume that a threshold value for determination of the remaining toner amount has been predefined. The CPU 309 determines based on the threshold value whether the remaining toner amount is large or small.

(S411): If the CPU 309 does not determine in step S410 that the remaining toner amount detected by the remaining toner amount detection sensor is small (NO in step S410), it recovers a normal image forming state. Then, the processing flow ends. The expression "normal image forming state" indicates performing image forming using both the first image forming apparatus 201 and second image forming apparatus 202.

Figure 9B:
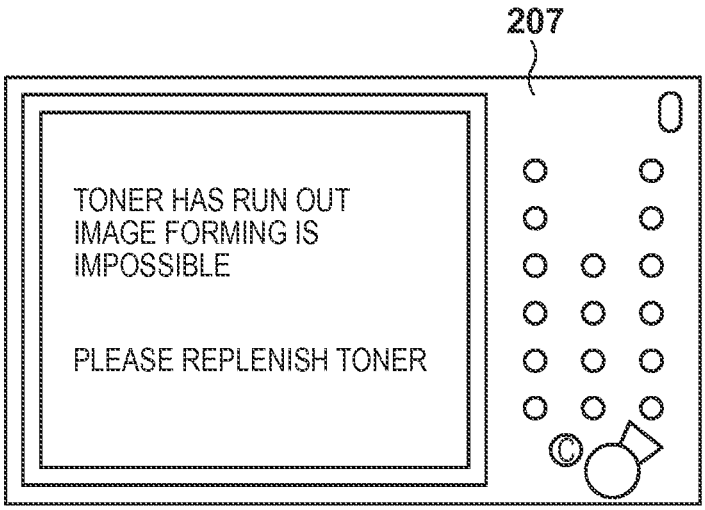

(S412): If the stop avoidance control is not effective, the CPU 309 completes a printing operation for all printing sheets which are being conveyed through the apparatus, and then displays a toner shortage error (using, for example, a display method shown in FIG. 9B) on the external display device 207. The process then advances to step S413.

(S413): After step S412, the CPU 309 completely stops each image forming apparatus. After that, the processing flow ends.

With the above-described stop avoidance control, even if one image forming apparatus cannot perform a printing operation due to a factor such as toner shortage, the connected image forming apparatus of this embodiment automatically switches to a printing operation using only the other image forming apparatus. This stop avoidance control halves the productivity but can continue the printing operation.

Note that the user can arbitrarily enable or disable the stop avoidance control using the advanced setting button 407 of FIG. 4A. The connected image forming apparatus of this embodiment enables the stop avoidance control as an initial setting. A case in which the stop avoidance control automatically operates when the remaining toner amount is small has been explained in this embodiment. However, a trigger of operating the stop avoidance control is not limited to this. For example, any image forming apparatus whose stop avoidance control operates when "an error which has no influence on a sheet conveying mechanism/function" such as sheet shortage or a full reclaim toner box is detected may be used. Determination criteria for the triggers have been predefined. Furthermore, the user may set, in detail, a trigger to be used to execute the stop avoidance control.

A case wherein when one image forming apparatus has stopped, the connected image forming apparatus to which the present invention is applicable can execute a double-sided printing operation using only the other normal image forming apparatus has been described. More specifically, when the user sets the image forming setting button 405 of the liquid crystal touch panel 403 or the stop avoidance control automatically operates, it is possible to execute a double-sided printing operation using only one normal image forming apparatus.

[Connected Operation Recovery Control]

Consider a case in which when one normal image forming apparatus continues a double-sided printing operation, the other image forming apparatus that cannot perform image forming is maintained and then a connected double-sided printing operation is recovered again. The present invention further provides, in this case, "connected operation recovery control" which can recover the best productivity. This embodiment reveals a problem for smoothly recovering the productivity and a practical example of the "connected operation recovery control" including the measurements against the problem will be explained in detail. A characteristic control flow part of this embodiment will be particularly described in detail.

Connected operation recovery control when the connected image forming apparatus of this embodiment recovers a connected double-sided operation from a state in which the first image forming apparatus 201 has stopped and the second image forming apparatus 202 is executing a double-sided printing operation will be explained.

Figure 10:
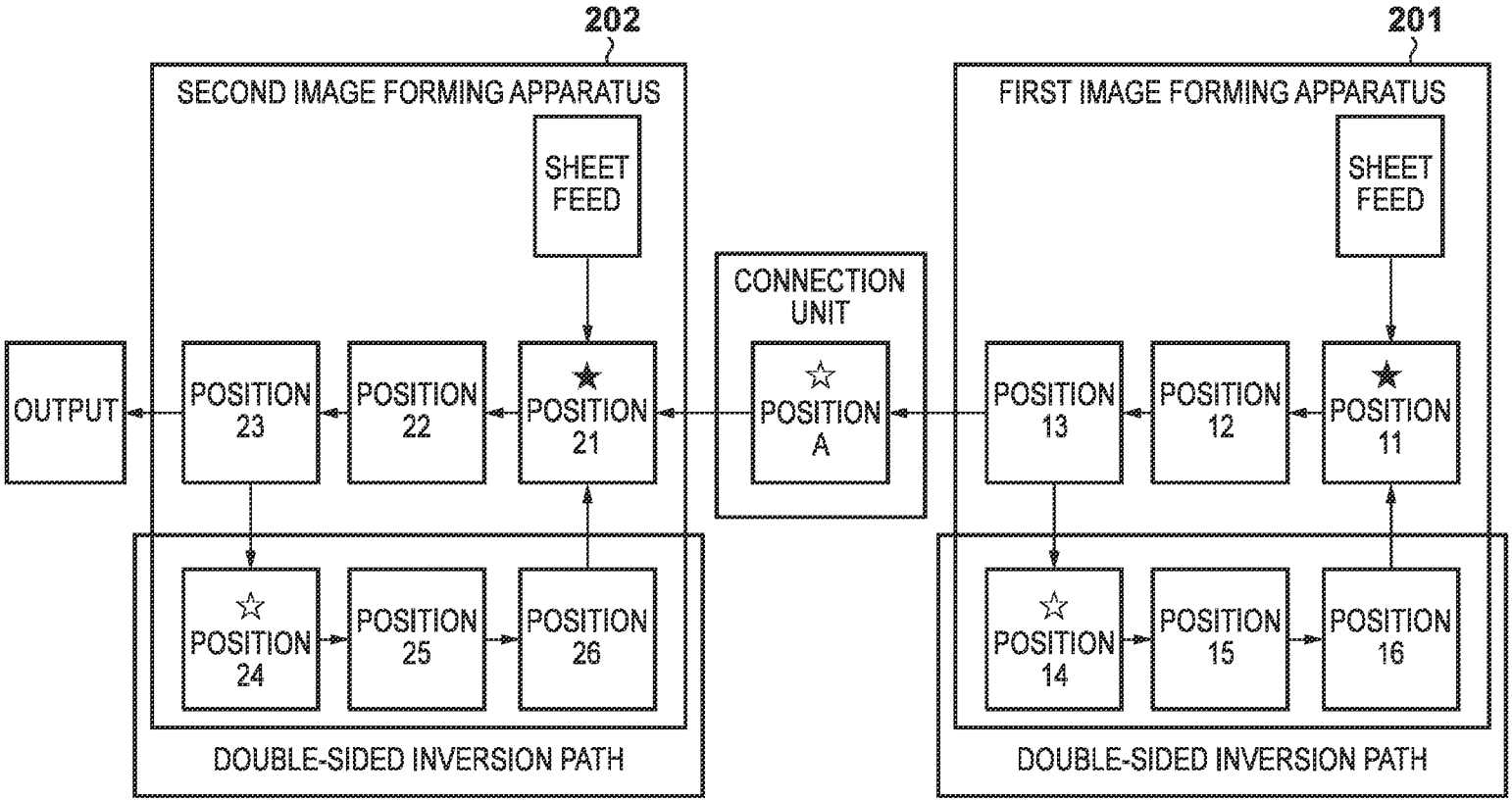
FIG. 10 is a view showing the position of a printing sheet on a conveying path according to the first embodiment.

In this embodiment, FIG. 10 schematically shows a position, of a printing sheet conveying path constituted by the first image forming apparatus 201, the second image forming apparatus 202, and a connection unit of them, where an A3 sheet exists when performing double-sided printing on the A3 sheet. Referring to FIG. 10, the large-capacity sheet feed deck 203 or a sheet feed cassette of the first image forming apparatus 201 feeds an A3 sheet to the first image forming apparatus 201. The secondary transfer roller 125 transfers an image to the first side of the fed A3 sheet at a position 11 (indicated by ★ in FIG. 10), and a conveying roller (not shown) conveys the A3 sheet along the conveying path within the apparatuses from a position 12 to a position 13. When the first image forming apparatus 201 prints the second side of the sheet, the sheet is conveyed from the position 13 to a position 14, and its front and back sides are inverted at the position 14 (indicated by ☆ in FIG. 10). The sheet is then conveyed from a position 15 to a position 16. The inverted and conveyed sheet undergoes transfer of a second-side image at the position 11, and is then conveyed from the position 12 to the position 13.

If the first image forming apparatus 201 has stopped printing and the second image forming apparatus 202 is performing a double-sided printing operation while being fed with a sheet from a sheet feed cassette of the second image forming apparatus 202 itself, the printing sheet conveying path within the first image forming apparatus 201 does not operate at all. If the first image forming apparatus 201 has stopped printing and the second image forming apparatus 202 is performing a double-sided printing operation while being fed with a sheet from the large-capacity sheet feed deck 203 or a sheet feed cassette of the first image forming apparatus 201, the printing sheet conveying path within the first image forming apparatus 201 only performs a sheet conveying operation.

When the A3 sheet is conveyed from the position 13 to the connection unit (corresponding to the relay unit 204 shown in FIG. 1), the connection unit inverts the front and back sides of the sheet at a position A (indicated by ☆ in FIG. 10), and conveys the sheet to the second image forming apparatus 202. Therefore, the connection unit (relay unit 204) or a sheet feed cassette of the second image forming apparatus 202 feeds an A3 sheet to the second image forming apparatus 202.

The secondary transfer roller transfers an image to the first side of the A3 sheet fed to the second image forming apparatus 202 at a position 21 (indicated by ★ in FIG. 10), and the sheet is conveyed along the conveying path within the apparatuses by a conveying roller (not shown) from a position 22 to a position 23. When the second image forming apparatus 202 prints the second side of the sheet, the sheet is conveyed from the position 23 to a position 24 where the front and back sides of the sheet are inverted (indicated by ☆ in FIG. 10). Then, the sheet is conveyed from a position 25 to a position 26. The inverted and conveyed sheet undergoes transfer of a second-side image at the position 21, is conveyed from the position 22 to the position 23, and is output to the large-capacity stacker 206.

If the second image forming apparatus 202 has stopped printing, and the first image forming apparatus 201 is performing a double-sided printing operation while being fed with a sheet from the large-capacity sheet feed deck 203 or a sheet feed cassette of the first image forming apparatus 201 itself, the printing sheet conveying path within the second image forming apparatus 202 only performs a sheet conveying operation. If the first image forming apparatus 201 and second image forming apparatus 202 perform a connected double-sided printing operation, the first image forming apparatus 201 prints the first side of a sheet, and the second image forming apparatus 202 prints the second side of the sheet. In this case, the sheet does not pass through the sheet inversion path of each image forming apparatus.

[Recovery Control when First Image Forming Apparatus has Stopped and Second Image Forming Apparatus can Perform Double-Sided Printing Operation]

Connected operation recovery control will be explained using the schematic view of FIG. 10 showing the conveying path. Assume that a sheet is fed from a sheet feed cassette of the second image forming apparatus 202. In this case, an A3 sheet conveying state after a double-sided printing operation using only the second image forming apparatus 202 starts will be described with reference to FIGS. 11 to 14. FIG. 11 shows a conventional example in which connected operation recovery control is not executed. FIG. 12 shows the embodiment (No. 1) to which connected operation recovery control according to the present invention is applied. With reference to FIGS. 13 and 14, the embodiment (Nos. 2 and 3) to which further improved connected operation recovery control according to the present invention is applied will be described.

A common way of reading tables shown in FIGS. 11 to 14 will be explained first. A column "step" of the tables represents time slots during which each A3 sheet sequentially passes through the positions of the conveying path of FIG. 10. A row indicates each position of a sheet in the conveying path of the connected image forming apparatus of this embodiment. Each number of the tables represents the order of a fed sheet after the first image forming apparatus 201 stops due to an error such as toner shortage and a double-sided printing operation using only the second image forming apparatus 202 starts. A black number in a white cell indicates a sheet whose second side has not undergone a transfer operation. A number in a hatched cell represents a sheet whose second side has undergone a transfer operation.

A column "output" of the tables indicates, in each step, the number of output sheets for which a double-sided printing operation is complete by control of the embodiment (Nos. 1, 2, and 3). A solid line (I) between steps 6 and 7 shown in each of FIGS. 11 to 14 represents the timing (to be referred to as a maintenance timing hereinafter) when a maintenance operation such as toner supply is performed for the first image forming apparatus 201 which has stopped. A dotted line (II) between steps 22 and 23 shown in each of FIGS. 11 to 14 indicates the timing when the first image forming apparatus 201 recovers from a printing stop state caused by toner shortage or the like and it becomes possible to perform a printing operation.

More specifically, the line (II) represents the timing when in the first image forming apparatus 201, a general recovery sequence (including a pre-rotation) such as toner supply, image forming position adjustment, and potential control is completed, a printing sheet is fed, and then it becomes possible to perform a transfer process in next step any time. Note that a pre-rotation indicates, for example, a well-known preparation operation for performing image forming when a photosensitive drum stops. A state in which it is possible to perform a transfer process any time will be referred to as a ready state. Since the timing when the image forming apparatus enters a ready state is uniquely determined based on the state of the image forming apparatus at the above-described maintenance timing, it is possible to predict, at the maintenance timing, the timing when the image forming apparatus enters a ready state.

FIGS. 11 to 14 will be individually described below. In FIG. 11, the connected image forming apparatus of the conventional example does not have control of recovering a connected operation. Even if the first image forming apparatus 201 enters a ready state between steps 22 and 23 in the table, therefore, it does not recover a printing operation. Thus, the productivity remains the same even after step 23, and only 17 A3 printing sheets can undergo double-sided printing output from when a double-sided printing operation using only the second image forming apparatus 202 starts until step 48.

Referring to the table shown in FIG. 12, in the connected image forming apparatus of this embodiment (No. 1), when the first image forming apparatus 201 enters a ready state between steps 22 and 23 in FIG. 12, the following connected operation recovery control is executed. When the first image forming apparatus 201 enters a ready state, an image has been transferred to the first side of the 10th sheet in the second image forming apparatus 202. Assume that immediately after the first image forming apparatus 201 enters a ready state, the second image forming apparatus 202 specializes in printing second-side images, and the first image forming apparatus 201 starts to transfer the first-side image of the 11th sheet. In this case, the 11th sheet whose first side has undergone printing is conveyed to the position 21 in step 27. Then, the second-side image of the 11th sheet is transferred earlier than the second-side image of the 10th sheet, thereby disturbing the order of output images.

As soon as the first image forming apparatus 201 enters a ready state, the second image forming apparatus 202 specializes in printing second-side images, and the first image forming apparatus 201 controls to wait for two steps and start printing first-side images in step 25. With this operation, the second-side images of the 11th sheet and subsequent sheets are smoothly connected after the second-side image of the 10th sheet in the second image forming apparatus 202. Consequently, the connected operation recovery control of this embodiment (No. 1) enables to complete double-sided printing output for 27 A3 sheets from when a double-sided printing operation using only the second image forming apparatus 202 starts until step 48, thereby recovering the productivity earlier.

[Connected Operation Recovery Control Flow]

Figure 15:
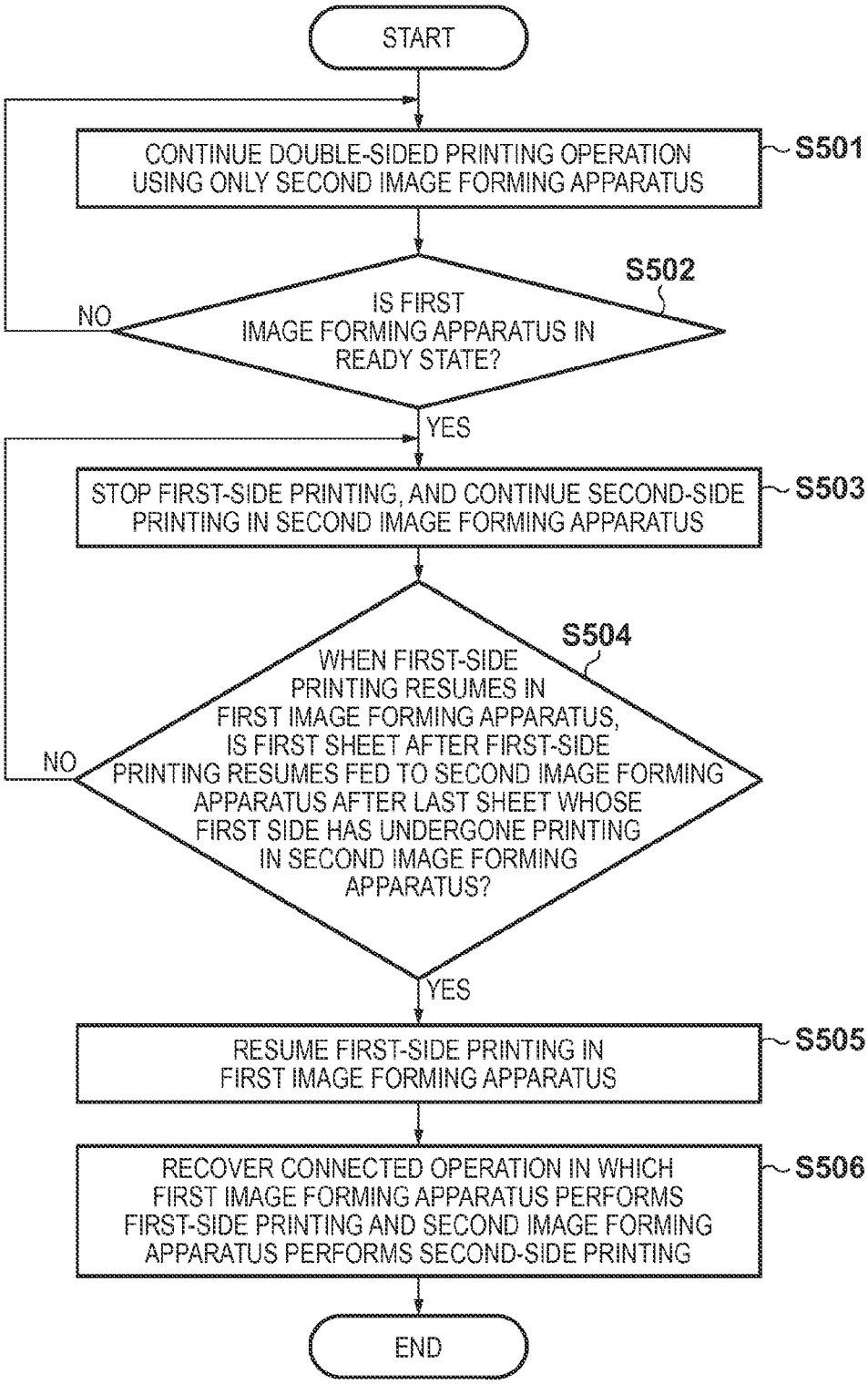
FIG. 15 is a flowchart illustrating connected operation recovery control according to the first embodiment.

FIG. 15 shows a control flowchart for the connected operation recovery control of this embodiment (No. 1) in the connected image forming apparatus, which has been described with reference to FIG. 12. Note that the operation of the flowchart to be described hereinafter is centrally controlled by the CPU 309 of the control apparatus 302 of FIG. 3, and the CPU 309 outputs a control instruction to the CPU 307 of the image forming apparatus 301 (that is, the CPU of each of the first and second image forming apparatuses). Assume that each CPU reads out and executes programs associated with the operation, which are stored in the storage unit.

(S501): The CPU 309 stops the first image forming apparatus 201 due to an error such as toner shortage, and continues a double-sided printing operation using only the second image forming apparatus 202 which can perform printing.

(S502): The CPU 309 determines whether the first image forming apparatus 201 has entered a ready state by performing a maintenance operation such as toner supply. If the first image forming apparatus 201 has not entered a ready state (NO in step S502), the CPU 309 continues the double-sided printing operation using the second image forming apparatus 202; otherwise (YES in step S502), the process advances to step S503.

(S503): If the first image forming apparatus 201 has entered a ready state (YES in step S502), the CPU 309 stops, in the second image forming apparatus 202, a first-side printing operation performed by newly feeding a printing sheet. Meanwhile, the CPU 309 continues a second-side printing operation for printing sheets remaining in the conveying path of the second image forming apparatus 202.

(S504): When the first image forming apparatus 201 resumes a first-side printing operation, the CPU 309 determines whether the first sheet after the first image forming apparatus 201 resumes the first-side printing operation is fed to the second image forming apparatus 202 after the last sheet whose first side has undergone printing in the second image forming apparatus 202 undergoes a second-side printing operation. As a determination method for the above condition, for example, the CPU 309 stores, in advance in the storage unit, a time taken for a sheet to pass through the positions of the conveying path of the first image forming apparatus 201 and second image forming apparatus 202. A sensor used for jam detection or the like detects the position of the last sheet whose first side has undergone printing in the second image forming apparatus 202. If the first sheet after the first image forming apparatus 201 resumes the first-side printing operation undergoes a second-side printing operation after the last sheet whose first side has undergone printing in the second image forming apparatus 202 (YES in step S504), the process advances to step S505; otherwise (NO in step S504), the process returns to step S503.

(S505): The CPU 309 resumes the first-side printing operation using the first image forming apparatus 201. This is because it is ensured by the determination in step S504 that the order of output images is not disturbed even if the first-side printing operation using the first image forming apparatus 201 resumes.

(S506): By the flow from step S501 to step S505, the CPU 309 recovers a connected double-sided printing operation in which the first image forming apparatus 201 prints the first side of a sheet and the second image forming apparatus 202 prints the second side of the sheet. Then, the processing flow ends.

[Connected Operation Recovery Control (No. 2)]

The connected operation recovery control of the connected image forming apparatus of this embodiment (No. 2) will be explained with reference to FIG. 13. When the first image forming apparatus 201 enters a ready state between steps 22 and 23 shown in FIG. 13, the following connected operation recovery control (No. 2) is performed.

Assume that the first image forming apparatus 201 has entered a ready state. In this case, referring to FIG. 12, the first-side image of the 10th sheet should have been transferred in the second image forming apparatus 202. Assume that immediately after the first image forming apparatus 201 enters a ready state, the second image forming apparatus 202 specializes in printing second-side images, and the first image forming apparatus 201 starts to transfer the first-side image of the 11th sheet. In this case, referring to FIG. 13, the 11th sheet whose first side has undergone printing is conveyed to the position 21 in step 27. Then, the second-side image of the 11th sheet is transferred earlier than the second-side image of the 10th sheet, thereby disturbing the order of output images. Furthermore, for the 10th sheet's images, if the first image forming apparatus 201 prints the first side of the sheet immediately after it enters a ready state, it is possible to convey the 10th sheet to a position where its second side can be printed, earlier as compared with a case in which the second image forming apparatus 202 prints the first side of the sheet.

A time (a step of the timing) when the first image forming apparatus 201 enters a ready state is predicted in advance based on a time taken to execute a general recovery sequence (including a pre-rotation) such as toner supply, image forming position adjustment, and potential control. Assume that the first image forming apparatus 201 resumes a first-side printing operation immediately after it enters a ready state. In this case, a step of the timing when the first sheet after the first-side printing operation resumes is fed to the transfer position (the position 21) of the second image forming apparatus 202 is predicted based on the predicted time when the first image forming apparatus 201 enters a ready state. In this embodiment, the predicted timing when the sheet reaches the position 21 of the second image forming apparatus 202 is step 27 in FIG. 13. For sheets (the 10th sheet and subsequent sheets) for which it is predicted that a process of transferring images to both sides in the second image forming apparatus 202 is incomplete at the predicted timing (step 27 in this embodiment) when the sheet reaches the second image forming apparatus 202, the second image forming apparatus 202 does not perform a first-side printing operation.

In this embodiment, a double-sided printing operation for the images of the ninth sheet is complete in step 26, and the 10th sheet whose first side has undergone printing in the first image forming apparatus 201 reaches the position 21 of the transfer process of the second image forming apparatus 202 in step 27. In the second image forming apparatus 202, the second-side images of the 11th sheet and subsequent sheets are smoothly connected after the second-side image of the 10th sheet. Consequently, the connected operation recovery control of this embodiment (No. 2) enables to complete double-sided printing output for 28 A3 sheets from when a double-sided printing operation using only the second image forming apparatus 202 starts until step 48, thereby recovering the productivity earlier.

[Connected Operation Recovery Control Flow (No. 2)]

Figure 16:
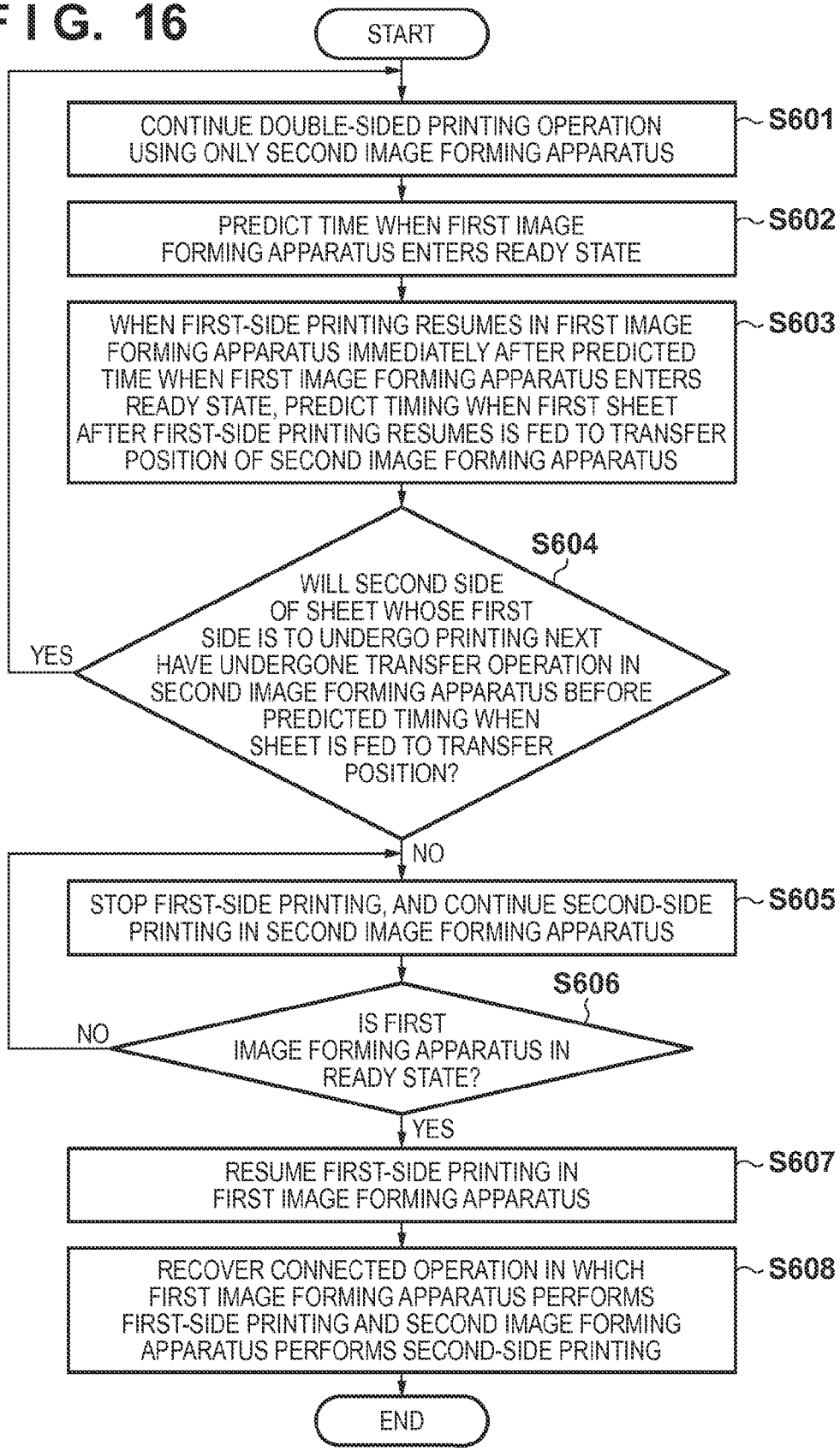
FIG. 16 is a flowchart illustrating connected operation recovery control according to the first embodiment.

FIG. 16 shows a control flowchart of the connected operation recovery control of this embodiment (No. 2) in the connected image forming apparatus, which has been described with reference to FIG. 13. Note that the operation of the flowchart to be described hereinafter is centrally controlled by the CPU 309 of the control apparatus 302 of FIG. 3, and the CPU 309 outputs a control instruction to the CPU 307 of the image forming apparatus 301 (that is, the CPU of each of the first and second image forming apparatuses). Assume that each CPU reads out and executes programs associated with the operation, which are stored in the storage unit.

(S601): The CPU 309 stops the first image forming apparatus 201 due to an error such as toner shortage, and continues a double-sided printing operation using only the second image forming apparatus 202 which can perform printing.

(S602): When a maintenance operation such as toner supply is performed, the CPU 309 predicts the timing when the first image forming apparatus 201 enters a ready state.

(S603): By assuming that the first image forming apparatus 201 resumes a first-side printing operation immediately after the timing predicted in step S602, the CPU 309 predicts the timing when the first sheet after the first-side printing operation resumes reaches/is fed to the position of a secondary transfer process of the second image forming apparatus 202.

(S604): The CPU 309 determines whether the second side of a sheet whose first side is to undergo image forming next will have undergone image forming in the second image forming apparatus 202 before the feeding timing predicted in step S603. If the second side of the sheet will have undergone printing (YES in step S604), the process returns to step S601; otherwise (NO in step S604), the process advances to step S605.

(S605): Based on the determination in step S604, the CPU 309 controls the second image forming apparatus 202 to stop subsequent first-side printing, and only execute second-side printing.

(S606): The CPU 309 determines whether the first image forming apparatus 201 has actually entered a ready state by performing a maintenance operation such as toner supply. If the first image forming apparatus 201 has not entered a ready state (NO in step S606), the CPU 309 continues a double-sided printing operation using the second image forming apparatus 202 (the process returns to step S605); otherwise (YES in step S606), the process advances to next step S607.

(S607): The CPU 309 causes the first image forming apparatus 201 to resume the first-side printing. This is because it is ensured by the determination in step S606 that the order of output images is not disturbed even if the first-side printing operation using the first image forming apparatus 201 resumes.

(S608): By the flow from step S601 to step S607, the CPU 309 recovers a connected double-sided printing operation in which the first image forming apparatus 201 performs first-side printing and the second image forming apparatus 202 performs second-side printing. Then, the processing flow ends.

[Connected Operation Recovery Control (No. 3)]

The connected operation recovery control of the connected image forming apparatus of this embodiment (No. 3) will be explained with reference to FIG. 14. When the first image forming apparatus 201 enters a ready state between steps 22 and 23 shown in FIG. 14, the following connected operation recovery control (No. 3) is performed.

Assume that the first image forming apparatus 201 has entered a ready state. In this case, referring to FIG. 12, the first-side image of the 10th sheet is assumed to have been transferred in the second image forming apparatus 202. Assume also that immediately after the first image forming apparatus 201 enters a ready state, the second image forming apparatus 202 specializes in printing second-side images, and the first image forming apparatus 201 starts to transfer the first-side image of the 11th sheet. In this case, referring to FIG. 14, the 11th sheet whose first side has undergone printing is conveyed to the position 21 in step 27. Then, the second-side image of the 11th sheet is transferred earlier than the second-side image of the 10th sheet, thereby disturbing the order of output images. Furthermore, for the 10th sheet's images, if the first image forming apparatus 201 prints the first side of the sheet immediately after it enters a ready state, it is possible to convey the 10th sheet to a position where its second side is printable, earlier as compared with a case in which the second image forming apparatus 202 prints the first side of the sheet. That is, prior to image forming in the first image forming apparatus 201, the second image forming apparatus 202 performs image forming for a page after a page for which the first image forming apparatus 201 performs image forming. At this time, the second image forming apparatus 202 can perform image forming prior to image forming in the first image forming apparatus 201 to the extent that inconsistency in order does not occur when sheets undergone image forming are output.

An elapsed time until the first image forming apparatus 201 enters a ready state (a step of the timing when the first image forming apparatus 201 enters a ready state) is predicted in advance based on a time taken to execute a recovery sequence (including a pre-rotation) for general recovery such as toner supply, registration adjustment, and potential control performed by the user. Assume that the first image forming apparatus 201 resumes a first-side printing operation immediately after it enters a ready state. In this case, a step of the timing when the first sheet after the first-side printing operation resumes is fed to the transfer position (the position 21) of the second image forming apparatus 202 is predicted based on the predicted time when the first image forming apparatus 201 enters a ready state. According to the predicted state of image forming, the recovery operation is switched. In this embodiment, the predicted timing when the sheet reaches the position 21 of the second image forming apparatus 202 is step 27 in FIG. 14. For a sheet whose first side has undergone printing in the second image forming apparatus 202 immediately before the first image forming apparatus 201 enters a ready state (step 22), a transfer process for both sides of the sheet in the second image forming apparatus 202 is completed in step 28.

As shown in FIG. 14, the second image forming apparatus 202 continues first-side printing until the first image forming apparatus 201 enters a ready state (step 22). On the other hand, immediately after the first image forming apparatus 201 enters a ready state (step 23), the first image forming apparatus 201 resumes the first-side printing. The second image forming apparatus 202 swaps images and prints the first side of the 11th sheet instead of the 10th sheet in step 22 so that the order of output materials after double-sided printing is not disturbed. On the other hand, the first image forming apparatus 201 swaps images and prints the first side of the 10th sheet instead of the 11th sheet in step 23. The first image forming apparatus 201 skips image forming in step 24, and then specializes in first-side printing in step 25 and subsequent steps. Skipping image forming in step 24 particularly indicates that the first image forming apparatus 201 waits for one step from when the first image forming apparatus 201 performs image forming for the 10th sheet until the first image forming apparatus 201 performs image forming for the 12th sheet. In this case, the second image forming apparatus 202 executes image forming for the 11th sheet.

As described above, in the connected operation recovery control of this embodiment (No. 3), first-side printing using the second image forming apparatus 202 continues until the first image forming apparatus 201 enters a ready state. Immediately after the first image forming apparatus 201 enters a ready state, it resumes first-side printing. The order of images used for first-side printing in the first image forming apparatus 201 or second image forming apparatus 202 is properly swapped. Control such that a change in order of images by this swapping operation does not disturb the order of the images of output materials is implemented.

A case in which the double-sided printing operation using only the second image forming apparatus 202 is performed by feeding sheets from a sheet feed cassette of the second image forming apparatus 202 has been explained above. However, it is also possible to similarly execute recovery control of the connected double-sided printing operation even when the double-sided printing operation is performed by feeding sheets from the large-capacity sheet feed deck or a sheet feed cassette of the first image forming apparatus 201.

As described above, it is possible to provide a connected image forming apparatus which can execute productivity recovery smoothly as much as possible by performing, when the first image forming apparatus 201 has stopped and the second image forming apparatus 202 is performing the double-sided printing operation, the connected operation recovery control for recovering the connected double-sided operation.

The embodiment has been described using an A3 size sheet for simplicity. According to the same concept, it is possible to propose, for sheets with other sizes, connected operation recovery control which can recover the productivity earlier.

Second Embodiment

In the first embodiment, connected operation recovery control when a connected double-sided operation is recovered from a state in which the first image forming apparatus 201 has stopped and the second image forming apparatus 202 is performing a double-sided printing operation has been described. In this embodiment, connected operation recovery control when a connected double-sided operation is recovered from a state in which the second image forming apparatus 202 has stopped and the first image forming apparatus 201 is performing a double-sided printing operation will be explained.

The configuration of the connected image forming apparatus of this embodiment is the same as in the first embodiment, and a repetitive explanation will be omitted. Only characteristic part of the connected operation recovery control in this embodiment will be explained in detail.

[Recovery Control when First Image Forming Apparatus can Perform Double-Sided Printing Operation and Second Image Forming Apparatus has Stopped]

In this embodiment, the conveying state of A3 printing sheets after start of a double-sided printing operation using only a first image forming apparatus 201 which is performed by feeding sheets from a large-capacity sheet feed deck or a sheet feed cassette of the first image forming apparatus 201 unlike the first embodiment will be described. This will be explained with reference to tables shown in FIGS. 17 to 19. FIG. 17 shows a conventional example in which connected operation recovery control is not executed. FIG. 18 shows the embodiment (No. 4) to which connected operation recovery control according to the present invention is applied. The embodiment (No. 5) to which further improved connected operation recovery control according to the present invention is applied will be described with reference to FIG. 19.

A common way of reading the tables shown in FIGS. 17 to 19 will be explained first. A column "step" of the tables represents time slots during which each A3 sheet sequentially passes through the positions of the conveying path of FIG. 10. A row indicates each position of a sheet in the conveying path of the connected image forming apparatus shown in FIG. 10. Each number of the tables represents the order of a fed sheet after a second image forming apparatus 202 stops due to an error such as toner shortage and a double-sided printing operation using only the first image forming apparatus 201 starts. A black number in a white cell indicates a sheet whose second side has not undergone a transfer operation. A number in a hatched cell represents a sheet whose second side has undergone a transfer operation.

For a sheet whose both sides have undergone image forming in the first image forming apparatus 201, the second image forming apparatus 202 performs operation of only conveying the sheet. Since, for example, all sheets (the first to 21st sheets) have undergone double-sided printing in the first image forming apparatus 201 in FIG. 17, the second image forming apparatus 202 only conveys the sheets undergone double-sided printing. Referring to FIG. 18, the first image forming apparatus 201 performs double-sided printing for the first to 10th sheets (steps 1 to 27), and the first image forming apparatus 201 and second image forming apparatus 202 share image forming for the remaining 11th to 30th sheets. Therefore, the second image forming apparatus 202 only conveys the first to 10th sheets but also performs image forming for the 11th to 30th sheets. It is possible to refer to FIG. 19 in the same manner.

A column "output" of the tables indicates, in each step, the number of output sheets for which a double-sided printing operation is complete and which have been output by control of the conventional example and the embodiment (Nos. 4 and 5). A solid line between steps 6 and 7 in each table represents the timing (to be referred to as a maintenance timing hereinafter) when a maintenance operation such as toner supply is performed for the second image forming apparatus 202 which has stopped. A dotted line between steps 22 and 23 in each table indicates the timing when the second image forming apparatus 202 recovers from a printing stop state caused by toner shortage or the like and it becomes possible to perform a printing operation. More specifically, the dotted line represents the timing when in the second image forming apparatus 202, a general recovery sequence (including a pre-rotation) such as toner supply, registration adjustment, and potential control is completed, an A3 printing sheet is fed, and then it becomes possible to perform a transfer process in the next step any time. A state in which it is possible to perform a transfer process any time will be referred to as a ready state. Since the timing when the image forming apparatus enters a ready state is uniquely determined based on the state of the image forming apparatus at the above-described maintenance timing, it is possible to predict, at the maintenance timing, the timing when the image forming apparatus enters a ready state.

FIGS. 17 to 19 will be individually described below. In the table shown in FIG. 17, the connected image forming apparatus of the conventional example does not have control of recovering a connected operation. Even if the second image forming apparatus 202 enters a ready state between steps 22 and 23 in the table of FIG. 17, therefore, it does not recover a printing operation. Thus, the productivity remains the same even after step 23, and only 15 A3 sheets undergo double-sided printing output from when a double-sided printing operation using only the first image forming apparatus 201 starts until step 48.

[Connected Operation Recovery Control (No. 4)]

Referring to the table shown in FIG. 18, in the connected image forming apparatus of this embodiment (No. 4), when the second image forming apparatus 202 enters a ready state between steps 22 and 23 in the table, the following connected operation recovery control is performed. When the second image forming apparatus 202 enters a ready state, the first image forming apparatus 201 has completed transfer of the first-side image of the 10th sheet. Assume that immediately after the second image forming apparatus 202 enters a ready state, the second image forming apparatus 202 attempts to perform second-side image printing, and the first image forming apparatus 201 attempts to specialize in printing first-side images. Referring to FIG. 18, however, the first image forming apparatus 201 cannot start to transfer the first-side image of the 11th sheet, since the first image forming apparatus 201 needs to convey the eighth and ninth sheets, which are being conveyed through a double-sided inversion path, to the second image forming apparatus 202 before the 10th sheet.

When the second image forming apparatus 202 enters a ready state, the first image forming apparatus 201 does not perform second-side printing for sheets (that is, the 10th sheet and subsequent sheets) other than those whose first sides have undergone printing by itself until now, and specializes in first-side printing thereafter. The second image forming apparatus 202 in a ready state stands by until step 32 (that is, until the last sheet whose second side has undergone printing in the first image forming apparatus 201 passes through), and then specializes in second-side printing in step 33 and subsequent steps. With this operation, in the second image forming apparatus 202, the second-side images of the 11th sheet and subsequent sheets are smoothly connected after the second-side image of the 10th sheet. That is, in the embodiment (No. 4), the first image forming apparatus 201 performs image forming for both the first and second sides of each of the first to 10th sheets. For the 11th sheet and subsequent sheets, the first image forming apparatus 201 performs image forming for the first side of each sheet, and the second image forming apparatus 202 performs image forming for the second side of each sheet. Consequently, the connected operation recovery control of this embodiment (No. 4) enables to complete double-sided printing output for 23 A3 sheets from when a double-sided printing operation using only the first image forming apparatus 201 starts until step 48, thereby recovering the productivity earlier.

[Connected Operation Recovery Control Flow (No. 4)]

Figure 20:
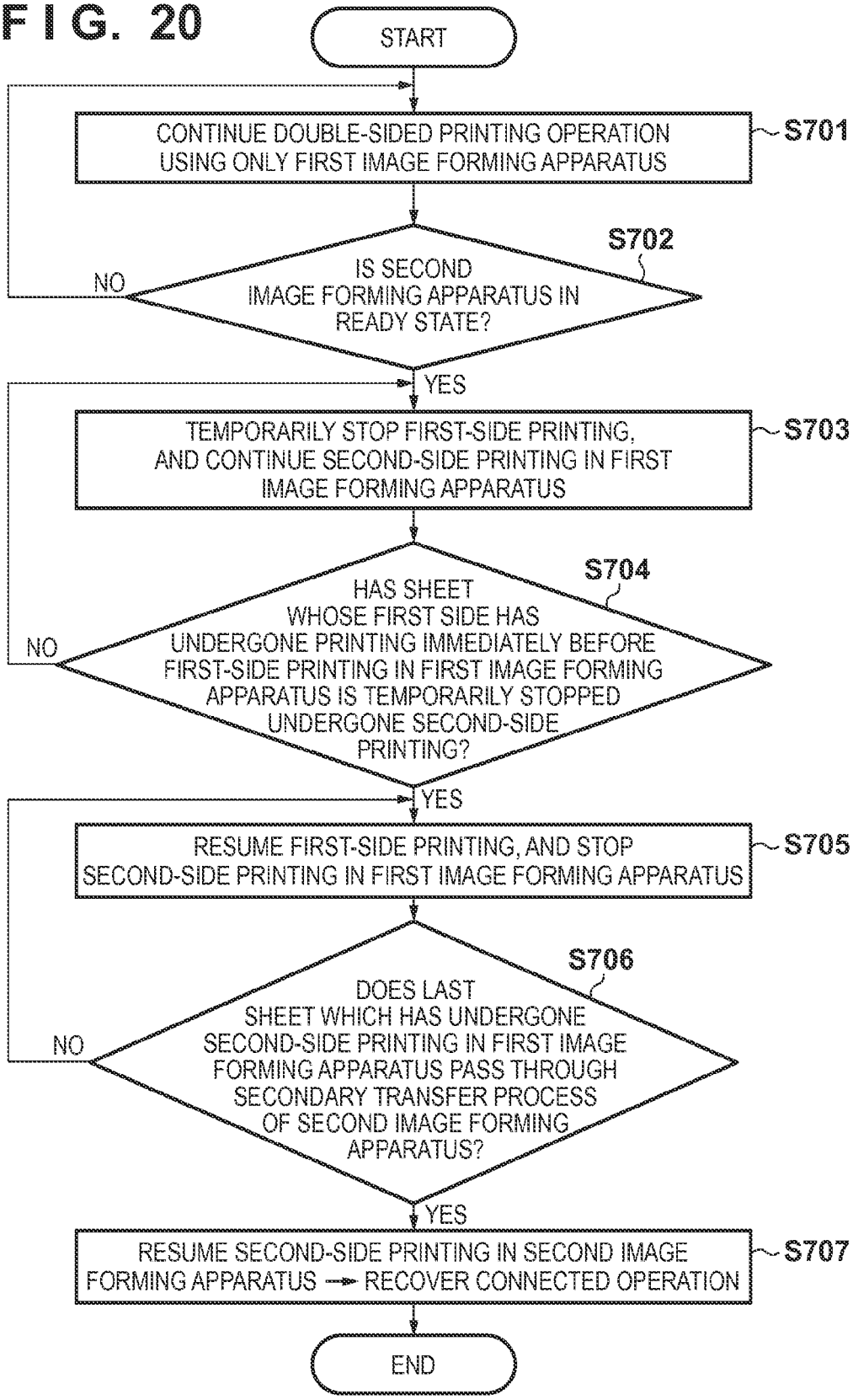
FIG. 20 is a flowchart illustrating connected operation recovery control according to the second embodiment.

FIG. 20 shows a control flowchart of the connected operation recovery control of this embodiment (No. 4) in the connected image forming apparatus, which has been described with reference to FIG. 18. Note that the operation of the flowchart to be described hereinafter is centrally controlled by a CPU 309 of a control apparatus 302 of FIG. 3, and the CPU 309 outputs a control instruction to a CPU 307 of an image forming apparatus 301 (that is, the CPU of each of the first and second image forming apparatuses). Assume that each CPU reads out and executes programs associated with the operation, which are stored in a storage unit.

(S701): The CPU 309 stops the second image forming apparatus 202 due to an error such as toner shortage, and continues a double-sided printing operation using only the first image forming apparatus 201 which can perform printing.

(S702): The CPU 309 determines whether the second image forming apparatus 202 has entered a ready state by performing a maintenance operation such as toner supply. If the second image forming apparatus 202 has not entered a ready state (NO in step S702), the CPU 309 continues a double-sided printing operation using the first image forming apparatus 201; otherwise (YES in step S702), the process advances to step S703.

(S703): If the first image forming apparatus 201 has entered a ready state (YES in step S702), the CPU 309 temporarily stops first-side printing in the first image forming apparatus 201. The CPU 309 continues second-side printing for printing materials remaining in the conveying path of the first image forming apparatus 201.

(S704): The CPU 309 determines whether the last sheet whose first side has undergone a transfer operation immediately before the CPU 309 temporarily stops the first-side printing in the first image forming apparatus 201 has undergone second-side printing by the first image forming apparatus 201. As a determination method of this, for example, the CPU 309 stores, in advance in the storage unit, a time taken for a sheet to pass through the positions of the conveying path of the first image forming apparatus 201 and second image forming apparatus 202. A jam detection sensor (not shown) or the like may detect the position of the last sheet whose first side has undergone printing in the first image forming apparatus 201. If the last sheet has undergone second-side printing in the first image forming apparatus 201 (YES in step S704), the process advances to step S705; otherwise (depending on the conveying path) (NO in step S704), the process returns to step S703.

(S705): Based on the determination in step S704, the CPU 309 stops second-side printing in the first image forming apparatus 201. Meanwhile, the CPU 309 resumes the first-side printing which has been temporarily stopped in the first image forming apparatus 201.

(S706): If the last sheet which has undergone second-side printing in the first image forming apparatus 201 passes through the transfer process position of the second image forming apparatus 202 (YES in step S706), the process advances to next step S707; otherwise (NO in step S706), the process returns to step S705 (the second image forming apparatus 202 practically stands by).

(S707): The CPU 309 resumes the second-side printing operation in the second image forming apparatus 202 to recover the connected double-sided printing operation in which the first image forming apparatus 201 performs first-side printing and the second image forming apparatus 202 performs second-side printing. Then, the processing flow ends.

[Connected Operation Recovery Control (No. 5)]

The connected operation recovery control of the connected image forming apparatus of this embodiment (No. 5) will be explained with reference to FIG. 19. When the second image forming apparatus 202 enters a ready state between steps 22 and 23 shown in FIG. 19, the following connected operation recovery control (No. 5 of this embodiment) is performed. Assume that the second image forming apparatus 202 has entered a ready state. In this case, the first-side image of the 10th sheet is assumed to have been transferred in the first image forming apparatus 201. Assume also that immediately after the second image forming apparatus 202 enters a ready state, the second image forming apparatus 202 attempts to specialize in printing second-side images. In this case, as in the above-described embodiment (No. 4), the second image forming apparatus 202 needs to stand by for the 10th sheet as the last sheet which has undergone second-side printing in the first image forming apparatus 201 to pass through the transfer process.

A time (a step of the timing) when the second image forming apparatus 202 enters a ready state is predicted in advance based on a time taken to execute a recovery sequence (including a pre-rotation) for general recovery such as toner supply, image forming position adjustment, and potential control. Assume that the second image forming apparatus 202 resumes the second-side printing immediately after it enters a ready state. In this case, a step of the timing when the first side of the last sheet immediately before the second-side printing resumes undergoes a transfer operation at the transfer position (position 11) of the first image forming apparatus 201 is predicted. According to the predicted state of image forming, the recovery operation is switched.

In this embodiment (No. 5), the last sheet immediately before the second-side printing resumes is the sixth sheet. Furthermore, referring to FIG. 19, the predicted timing when the first side of the sixth sheet undergoes a transfer operation at the position 11 of the first image forming apparatus 201 is step 12. It is apparent from this that the sheet whose first side has undergone printing in the first image forming apparatus 201 in step 12 or subsequent step can be output earlier if the second image forming apparatus 202 performs second-side printing for the sheet, as compared with a case in which the first image forming apparatus 201 performs second-side printing.

In this embodiment (No. 5), sheets (that is, the seventh sheet and subsequent sheets) which are predicted to undergo first-side printing in step 12 and subsequent steps are made to stand by without undergoing printing. After the last sheet (that is, the sixth sheet) immediately before the second-side printing resumes undergoes second-side printing in the first image forming apparatus 201 (that is, in step 18 or subsequent step), first-side printing for the sheets which stand by resumes. With this operation, in the second image forming apparatus 202, the second-side images of the seventh sheet and subsequent sheets are smoothly connected after the second-side image of the sixth sheet. Consequently, the connected operation recovery control of this embodiment (No. 5) enables to complete double-sided printing output for 32 A3 sheets from when a double-sided printing operation using only the first image forming apparatus 201 starts until step 48, thereby recovering the productivity earlier.

[Connected Operation Recovery Control Flow (No. 5)]

Figure 21:
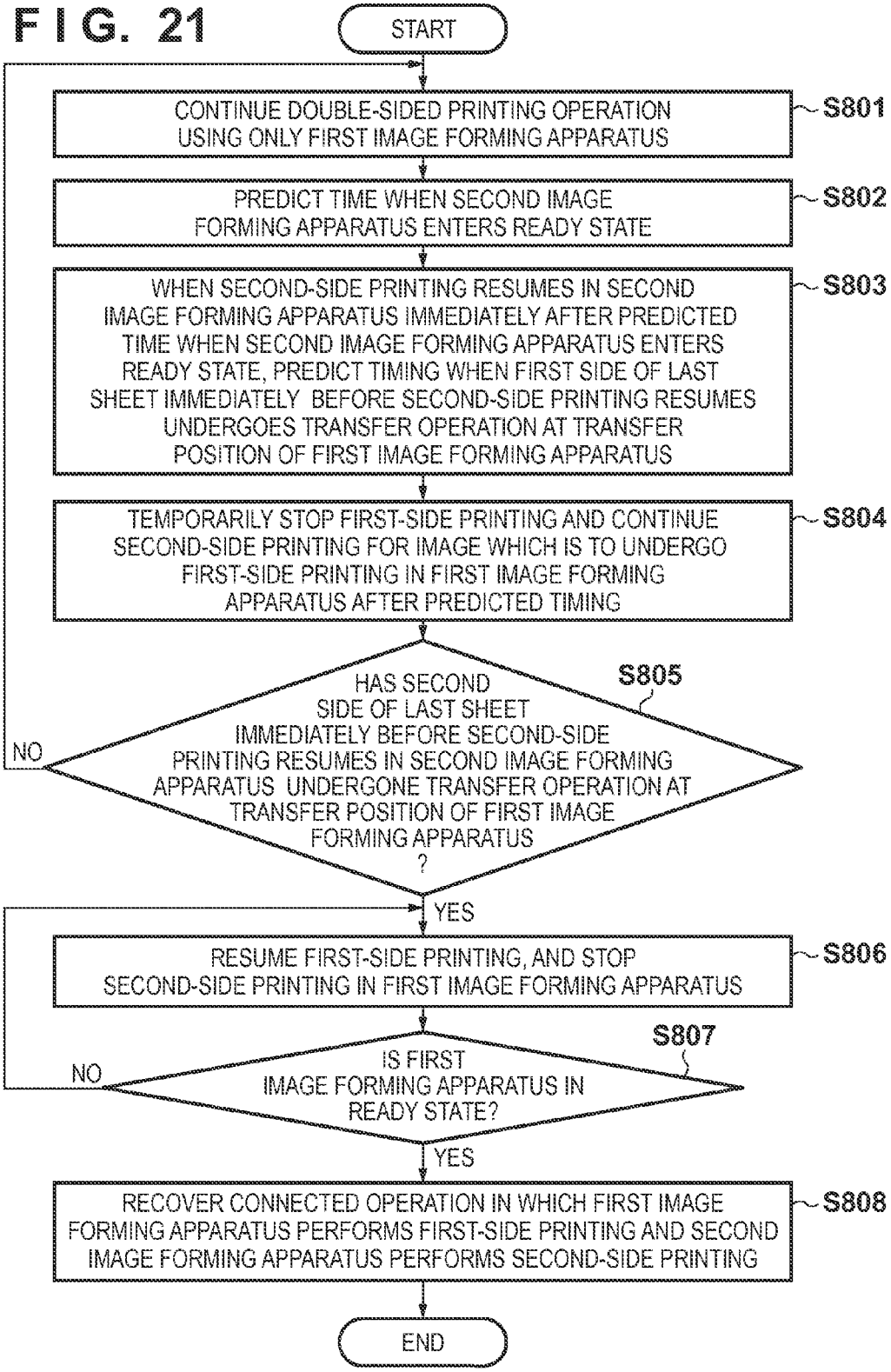
FIG. 21 is a flowchart illustrating connected operation recovery control according to the second embodiment.

FIG. 21 shows a control flowchart of the connected operation recovery control of this embodiment (No. 5) in the connected image forming apparatus, which has been described with reference to FIG. 18. Note that the operation of the flowchart to be described hereinafter is centrally controlled by the CPU 309 of the control apparatus 302 of FIG. 3, and the CPU 309 outputs a control instruction to the CPU 307 of the image forming apparatus 301 (that is, the CPU of each of the first and second image forming apparatuses). Assume that each CPU reads out and executes programs associated with the operation, which are stored in the storage unit.

(S801): The CPU 309 stops the second image forming apparatus 202 due to an error such as toner shortage, and continues a double-sided printing operation using only the first image forming apparatus 201 which can perform printing.

(S802): When a maintenance operation such as toner supply is performed, the CPU 309 predicts the timing when the second image forming apparatus 202 enters a ready state.

(S803): By assuming that the second image forming apparatus 202 resumes second-side printing immediately after the timing predicted in step S802, the CPU 309 predicts the timing when the last sheet immediately before the second-side printing resumes undergoes first-side printing at the secondary transfer process position of the first image forming apparatus 201.

(S804): The CPU 309 temporarily stops first-side printing for sheets whose first sides are to undergo a transfer operation in the first image forming apparatus 201 at the timing predicted in step S803 and thereafter. On the other hand, the CPU 309 continues second-side printing for sheets already existing in the conveying path of the first image forming apparatus 201.

(S805): The CPU 309 determines whether the last sheet immediately before the second-side printing resumes has undergone second-side printing at the secondary transfer process position of the first image forming apparatus 201. If the last sheet has not undergone second-side printing (NO in step S805), the process returns to step S804; otherwise (YES in step S805), the process advances to step S806.

(S806): If the CPU 309 determines in step S805 that the last sheet has undergone second-side printing, it stops second-side printing in the first image forming apparatus 201 while resuming first-side printing in the first image forming apparatus 201.

(S807): The CPU 309 determines whether the second image forming apparatus 202 has actually entered a ready state by performing a maintenance operation such as toner supply. If the second image forming apparatus 202 has not entered a ready state (NO in step S807), the CPU 309 continues a printing operation using the first image forming apparatus 201 (the process returns to step S806); otherwise (YES in step S807), the process advances to next step S808.

(S808): By the flow from step S801 to step S807, the CPU 309 recovers a connected double-sided printing operation in which the first image forming apparatus 201 performs first-side printing and the second image forming apparatus 202 performs second-side printing. This is because it is ensured by the determination in step S807 that the order of output images is not disturbed even if second-side printing using the second image forming apparatus 202 resumes. Then, the processing flow ends.

As described above, it is possible to execute productivity recovery smoothly as much as possible by performing, when the second image forming apparatus 202 has stopped and the first image forming apparatus 201 is performing the double-sided printing operation, the connected operation recovery control shown in FIGS. 20 and 21 for recovering the connected double-sided operation.

The embodiment has been described using an A3 size sheet for simplicity. According to the same concept, it is possible to propose, for sheets with other sizes, connected operation recovery control which can recover the productivity earlier.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-212707, filed Sep. 22, 2010, which is hereby incorporated by reference herein in its entirety.

What is claimed is:

1. An image forming system in which a first image forming apparatus and a second image forming apparatus downstream of said first image forming apparatus are connected, comprising:

a switching unit configured to switch between a first mode in which said second image forming apparatus forms images on first and second sides of a sheet and a second mode in which said first image forming apparatus forms an image on a first side of a sheet and said second image forming apparatus forms an image on a second side of the sheet; and a control unit configured to control at least one of said first image forming apparatus and said second image forming apparatus so that when switching from the first mode in which said second image forming apparatus forms images on first and second sides of a sheet to the second mode in which said first image forming apparatus forms an image on a first side of a sheet and said second image forming apparatus forms an image on a second side of the sheet, if said second image forming apparatus is unable to perform image forming on a second side of a sheet whose first side has undergone image forming in said second image forming apparatus before said second image forming apparatus performs image forming on a second side of a sheet whose first side has undergone image forming in said first image forming apparatus, an order of the sheet whose first and second sides undergo image forming in said second image forming apparatus and the sheet whose first side undergoes image forming in said first image forming apparatus and whose second side undergoes image forming in said second image forming apparatus is not swapped.

2. The system according to claim 1, wherein said control unit controls a timing when said first image forming apparatus starts image forming on a first side of a sheet so that a sheet whose first side has undergone image forming in said first image forming apparatus reaches said second image forming apparatus after a second side of a last sheet whose first side has undergone image forming in said second image forming apparatus at timing that said first image forming apparatus has entered an image forming enable state undergoes image forming in said second image forming apparatus.

3. A control apparatus which controls a first image forming apparatus and a second image forming apparatus connected downstream of the first image forming apparatus, wherein said control apparatus controls at least one of the first image forming apparatus and the second image forming apparatus so that when switching from a first mode in which the second image forming apparatus forms images on first and second sides of a sheet to a second mode in which the first image forming apparatus forms an image on a first side of a sheet and the second image forming apparatus forms an image on a second side of the sheet, if the second image forming apparatus is unable to perform image forming on a second side of a sheet whose first side has undergone image forming in the second image forming apparatus before the second image forming apparatus performs image forming on a second side of a sheet whose first side has undergone image forming in the first image forming apparatus, an order of the sheet whose first and second sides undergo image forming in the second image forming apparatus and the sheet whose first side undergoes image forming in the first image forming apparatus and whose second side undergoes image forming in the second image forming apparatus is not swapped.

* * * * *